US011298579B2

(12) United States Patent
Kao

(10) Patent No.: US 11,298,579 B2
(45) Date of Patent: Apr. 12, 2022

(54) RESISTANCE SUPPLIER FOR WEIGHT TRAINING

(71) Applicant: Chien-Ping Kao, Taipei (TW)

(72) Inventor: Chien-Ping Kao, Taipei (TW)

(73) Assignee: Chien-Ping Kao, Taipei (TW)

( * ) Notice: Subject to any disclaimer, the term of this patent is extended or adjusted under 35 U.S.C. 154(b) by 100 days.

(21) Appl. No.: 17/003,922

(22) Filed: Aug. 26, 2020

(65) Prior Publication Data

US 2022/0062691 A1 Mar. 3, 2022

(51) Int. Cl.
*A63B 21/22* (2006.01)
*A63B 21/00* (2006.01)
*A63B 24/00* (2006.01)

(52) U.S. Cl.
CPC ..... *A63B 21/22* (2013.01); *A63B 21/153* (2013.01); *A63B 21/157* (2013.01); *A63B 24/0062* (2013.01); *A63B 2209/08* (2013.01); *A63B 2220/803* (2013.01); *A63B 2220/833* (2013.01)

(58) Field of Classification Search
CPC ..... A63B 21/22; A63B 21/153; A63B 21/157; A63B 24/0062; A63B 2209/08; A63B 2220/803; A63B 2220/833
See application file for complete search history.

(56) References Cited

U.S. PATENT DOCUMENTS 4,135,714 A * 1/1979 Hughes ..... A63B 69/36212 482/127
4,328,965 A * 5/1982 Hatfield ..... A63B 21/025 124/23.1
4,685,670 A * 8/1987 Zinkin ..... A63B 21/1681 482/129
4,779,866 A * 10/1988 Marshall ..... A63B 21/00069 482/116
4,961,573 A * 10/1990 Wehrell ..... A63B 21/0552 482/124

(Continued)

FOREIGN PATENT DOCUMENTS

WO 2020084186 A1 4/2020

OTHER PUBLICATIONS

Search Report for United Kingdom Patent Application No. GB2014881.3 dated Mar. 22, 2021, 4 pages.

*Primary Examiner* — Garrett K Atkinson
(74) *Attorney, Agent, or Firm* — Withrow & Terranova, P.L.L.C; Vincent K. Gustafson

(57) ABSTRACT

A resistance supplier for weight training has two switching assemblies, two planetary gear sets, a one-way output bearing, a spindle, and at least one weight. The two switching assemblies respectively control input, output, and fixing of the sun gear, planet carrier, and ring gear in the two planetary gear sets. The output of one of the two planetary gear sets is used as the input of the other planetary gear set. Therefore, the two planetary gear sets provide three reduction ratios and transmit torque to the spindle through the one-way output bearing to drive the weight to rotate. By using reduction ratios of the planetary gear sets to increase the output requirement of the user and switching gears via switching assemblies to change reduction ratios, the resistance supplier can provide sufficient and diverse training resistances with a single weight, thereby reducing the volume.

14 Claims, 17 Drawing Sheets

(56) References Cited

U.S. PATENT DOCUMENTS 4,979,733 A * 12/1990 Prud'Hon ..... A63B 21/0058 482/4
5,033,733 A 7/1991 Findlay
5,090,694 A * 2/1992 Pauls ..... A63B 21/015 482/118
5,147,265 A * 9/1992 Pauls ..... A63B 21/015 482/115
5,226,867 A * 7/1993 Beal ..... A63B 21/153 482/120
5,382,212 A * 1/1995 Davenport ..... A63B 21/04 482/121
5,486,149 A * 1/1996 Smith ..... A63B 21/015 482/120
5,586,962 A * 12/1996 Hallmark ..... A63B 21/04 482/123
5,618,249 A * 4/1997 Marshall ..... A63B 21/153 482/115
5,733,231 A * 3/1998 Corn ..... A63B 21/025 482/120
6,436,006 B1 * 8/2002 Zemlyakov ..... A63B 21/0083 482/112
6,440,044 B1 * 8/2002 Francis ..... A63B 21/0455 482/114
6,685,602 B2 * 2/2004 Colosky, Jr. ..... A63B 21/025 482/122
6,929,589 B1 * 8/2005 Bruggemann ..... A63B 21/025 482/121
7,137,936 B1 * 11/2006 Shaw ..... A63B 21/025 482/127
7,462,141 B1 * 12/2008 Raboin ..... A63B 21/225 482/110
7,871,359 B2 * 1/2011 Humble ..... A63B 21/153 482/127
7,878,955 B1 * 2/2011 Ehrlich ..... A63B 21/025 482/127
8,002,677 B2 * 8/2011 Dibble ..... A63B 21/4047 482/92
8,070,657 B2 * 12/2011 Loach ..... A63B 21/225 482/72
9,320,936 B1 * 4/2016 Rea ..... A63B 21/4009
11,213,718 B1 * 1/2022 Tipple ..... A63B 21/00069
2002/0025891 A1 * 2/2002 Colosky, Jr. ..... A63B 21/0455 482/127
2005/0181915 A1 * 8/2005 Hoecht ..... A63B 21/023 482/127
2010/0130338 A1 * 5/2010 Wehrell ..... A63B 21/154 482/124
2021/0353994 A1 * 11/2021 Paz Domonte ..... A63B 21/225
2021/0368741 A1 * 12/2021 Duffin ..... B65H 75/406
2021/0402249 A1 * 12/2021 Tipple ..... A63B 24/0087

* cited by examiner

RESISTANCE SUPPLIER FOR WEIGHT TRAINING

BACKGROUND

1. Field of the Invention

The present invention relates to fitness equipment, especially to a resistance supplier for weight training.

2. Description of the Prior Art

In recent years, fitness has been increasingly valued by the public, and weight training is one of the most popular exercises. Conventionally, a piece of weight training equipment is mainly composed of a frame and multiple weights. The weights are stacked on top of each other. The user fixes the required amount of the weights through a bolt, and pulls and lifts the weights with a pulling rope for training.

However, the conventional weight training equipment has the following disadvantages:

1. The volume is too large. Since the weights must be lifted up, a sufficient height of the frame is required, and since the weights themselves already have certain amounts of volume and weight, the frame must have sufficient width and rigidity to stably support the weights. Therefore, the conventional weight training equipment usually has a huge volume that occupies large indoor space and makes the conventional weight training equipment not suitable for everyone to place in a household environment for use at home.

2. It is quite dangerous in use. Since the conventional weight training equipment provides training resistance mainly by gravity, the weights must be lifted up and then dropped down when in use. In this way, the user might be accidentally smashed by the weights during operation or while adjusting the amount of the weights with the bolt, causing serious injury.

To overcome the shortcomings, the present invention provides a resistance supplier for weight training to mitigate or obviate the aforementioned problems.

SUMMARY OF THE INVENTION

The main objective of the present invention is to provide a resistance supplier for weight training with a small volume so that the resistance supplier can be placed anywhere in a household environment and is suitable for use at home. Further, the resistance supplier provides training resistance by rotation of the weights and by reduction ratio of planetary gear sets, thereby preventing the user from being smashed by the weights.

The resistance supplier for weight training has a spindle, a first transmission unit, an input assembly, a first planetary gear set, a first switching assembly, a second transmission unit, a second planetary gear set, a second switching assembly, an output assembly, and at least one weight.

The spindle has an axial direction, a first rotating direction, and a second rotating direction being reverse to the first rotating direction.

The first transmission unit is rotatably mounted around the spindle.

The input assembly has a one-way input bearing and a pulling rope. The one-way input bearing is capable of driving the first transmission unit to rotate along the first rotating direction. The pulling rope is connected to the one-way input bearing. The pulling rope is capable of driving the first transmission unit to rotate along the first rotating direction via the one-way input bearing.

The first planetary gear set has a first sun gear, multiple first planet gears, two first planet carriers, and a first ring gear. The first sun gear is rotatably mounted around the spindle. The first planet gears engage with the first sun gear. Each of the first planet carriers is connected to axles of the first planet gears. In the axial direction, the two first planet carriers are respectively located in two sides of the first planet gears. The first ring gear engages with the first planet gears.

The first switching assembly has a first switching unit, a first rotating unit, and a first fixing unit. The first switching unit is capable of moving along the axial direction relative to the first transmission unit and the first planetary gear set. The first rotating unit is mounted around the first transmission unit. The first transmission unit is capable of driving the first rotating unit to rotate. In the axial direction, the first switching unit abuts two sides of the first rotating unit and is capable of driving the first rotating unit to move along the axial direction relative to the first transmission unit and the first planetary gear set. The first rotating unit has at least one first driving segment. The first driving segment is capable of moving along with the first rotating unit relative to the first planetary gear set to connect to one of the two first planet carriers, or to connect to the first ring gear. The first fixing unit is securely mounted on the first switching unit and is capable of moving along with the first switching unit relative to the first planetary gear set. The first fixing unit has at least one first fixing segment. The first fixing segment is capable of moving along with the first fixing unit relative to the first planetary gear set to connect to and fix one of the two first planet carriers, or to connect to and fix the first ring gear. When the at least one first driving segment abuts one of the two first planet carriers, the at least one first fixing segment abuts and fixes the first ring gear, and the first rotating unit is capable of driving said one of the two first planet carriers to rotate via the at least one first driving segment, and then said one of the two first planet carriers drives the first sun gear to rotate. When the at least one first driving segment abuts the first ring gear, the at least one first fixing segment abuts and fixes one of the two first planet carriers, and the first rotating unit is capable of driving the first ring gear to rotate via the at least one first driving segment, and then the first ring gear drives the first sun gear to rotate.

The second transmission unit is rotatably mounted around the spindle and is securely mounted on the first sun gear.

The second planetary gear set has a second sun gear, multiple second planet gears, two second planet carriers, and a second ring gear. The second transmission unit is rotatably mounted through the second sun gear. The second planet gears engage with the second sun gear. Each of the two second planet carriers is connected to axles of the second planet gears. In the axial direction, the two second planet carriers are respectively located in two sides of the second planet gears. The second ring gear engages with the second planet gears.

The second switching assembly has a second switching unit, a second rotating unit, and a second fixing unit. The second switching unit is capable of moving along the axial direction relative to the second transmission unit and the second planetary gear set. The second rotating unit is mounted around the second transmission unit. The second transmission unit is capable of driving the second rotating unit to rotate. In the axial direction, the second switching unit abuts two sides of the second rotating unit and is capable of driving the second rotating unit to move along the axial direction relative to the second transmission unit and the second planetary gear set. The second rotating unit has at least one second driving segment. The at least one second driving segment is capable of moving along with the second rotating unit relative to the second planetary gear set to connect to one of the two second planet carriers, or to connect to the second ring gear, or not to connect to any one of the two second planet carriers and the second ring gear. The second fixing unit is securely mounted on the second switching unit and is capable of moving along with the second switching unit relative to the second planetary gear set. The second fixing unit has at least one second fixing segment. The at least one second fixing segment is capable of moving along with the second fixing unit relative to the second planetary gear set to connect to and fix one of the two second planet carriers, or to connect to and fix the second ring gear, or not to connect to any one of the two second planet carriers and the second ring gear. When the at least one second driving segment abuts one of the two second planet carriers, the at least one second fixing segment abuts and fixes the second ring gear, and the second rotating unit is capable of driving said one of the two second planet carriers to rotate via the at least one second driving segment, and then said one of the two second planet carriers drives the second sun gear to rotate, and the at least one first driving segment abuts one of the two first planet carriers. When the at least one second driving segment abuts the second ring gear, the at least one second fixing segment abuts and fixes one of the two second planet carriers, and the second rotating unit is capable of driving the second ring gear to rotate via the at least one second driving segment, and then the second ring gear drives the second sun gear to rotate, and the at least one first driving segment abuts the first ring gear. When the at least one second driving segment does not abut any one of the two second planet carriers and the second ring gear, the at least one second fixing segment does not abut any one of the two second planet carriers and the second ring gear, and the second rotating unit does not drive any one of the two second planet carriers and the second ring gear to rotate via the at least one second driving segment, and the at least one first driving segment abuts the first ring gear.

The output assembly has a driven unit, an output unit, and a one-way output bearing. The driven unit is rotatably mounted on the second transmission unit and is securely mounted on the second sun gear. The output unit is securely mounted on the driven unit and on the spindle. The one-way output bearing has an output bearing outer ring and an output bearing inner ring. The output bearing outer ring is securely mounted on the driven unit. The output bearing inner ring is securely mounted around the second transmission unit. The output bearing inner ring is capable of driving the output bearing outer ring and the driven unit to rotate along the first rotating direction. The output bearing inner ring is capable of rotating along the second rotating direction relative to the output bearing outer ring.

The at least one weight is securely mounted on the spindle and is capable of rotating along with the spindle.

By using reduction ratio and enlargement effect of the planetary gear sets to increase the output requirement of the user, the present invention is capable of providing sufficient training resistance through one single small, light weight without the need of multiple weights such as in the conventional weight training equipment. Besides, by switching the input gear, output gear, and release gear of the two planetary gear sets to create different reduction ratios, the present invention can provide a variety of training resistances with the single weight. Therefore, the volume, the weight, and the amount of the weights in the present invention can be much less than those of the weights in the conventional weight training equipment. Further, the present invention provides training resistance by rotating the weight instead of lifting up the weight, so a tall frame is no longer necessary in the present invention, thereby significantly reducing the volume, and thus the present invention is suitable for any ordinary user in a household environment for use at home.

In addition, since the present invention provides the training resistance by rotating the weight instead of lifting up the weight, and since the training resistance in the present invention can be adjusted by switching the reduction ratio instead of fixing different amounts of weights with a bolt, the risk of being smashed by weights in use can be completely avoided.

Other objectives, advantages and novel features of the invention will become more apparent from the following detailed description when taken in conjunction with the accompanying drawings.

DETAILED DESCRIPTION

Figure 1:
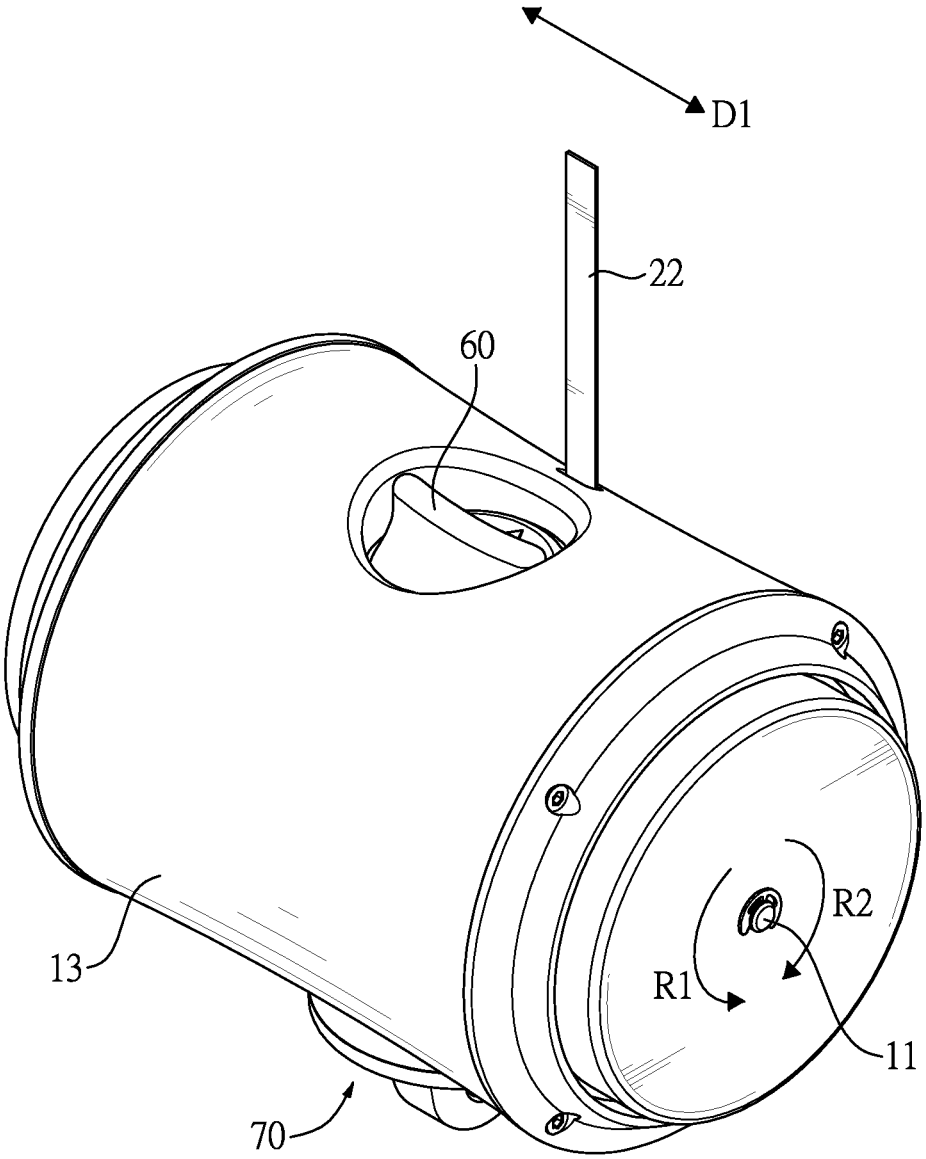
FIG. 1 is a perspective view of a resistance supplier for weight training in accordance with the present invention.
Figure 2:
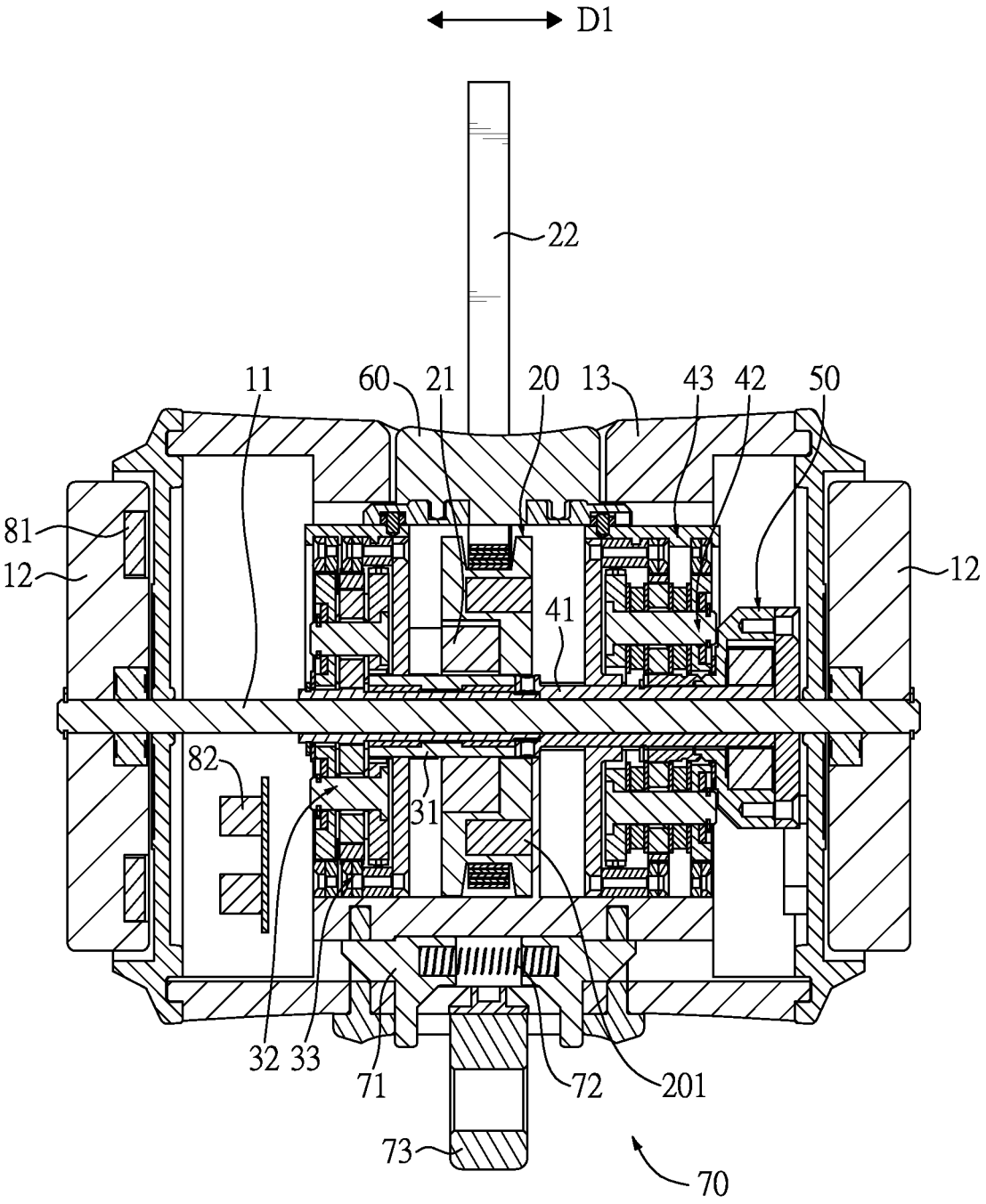
FIG. 2 is a side view in cross section of the resistance supplier for weight training in FIG. 1.

With reference to FIGS. 1 and 2, a resistance supplier for weight training in accordance with the present invention comprises a spindle 11, at least one weight 12, an input assembly 20, a first transmission unit 31, a first planetary gear set 32, a first switching assembly 33, a second transmission unit 41, a second planetary gear set 42, a second switching assembly 43, and an output assembly 50.

The spindle 11 has an axial direction D1, a first rotating direction R1, and a second rotating direction R2 being reverse to the first rotating direction R1.

The weight 12 is securely mounted on the spindle 11 and is capable of rotating along with the spindle 11. Additionally, in this embodiment, the resistance supplier for weight training has two weights 12 respectively mounted on two ends of the spindle 11, but an amount of the at least one weight 12 is not limited to the aforementioned in any other embodiments.

The input assembly 20 has a reel 201, a one-way input bearing 21, and a pulling rope 22. The reel 201 has a reed. In other words, the reel 201 is a reed reel in this embodiment. The one-way input bearing 21 has an input bearing inner ring and an input bearing outer ring. The input bearing inner ring is securely mounted around the first transmission unit 31. The input bearing outer ring is capable of driving the input bearing inner ring and the first transmission unit 31 to rotate along the first rotating direction R1, and is capable of rotating relative to the input bearing inner ring and the first transmission unit 31 along the second rotating direction R2. In other words, when the input bearing outer ring is rotating along the first rotating direction R1, the input bearing outer ring buckles and drives the input bearing inner ring. Conversely, when the input bearing outer ring is rotating along the second rotating direction R2, the input bearing inner ring is released and will not be driven. The pulling rope 22 is connected to the input bearing outer ring, and is capable of driving the input bearing outer ring to rotate along the first rotating direction R1. The reel 201 is connected to the input bearing outer ring, and the reed of the reel 201 is configured to drive the input bearing outer ring to rotate along the second rotating direction R2 to roll up the pulling rope 22. By this, the pulling rope 22 is capable of driving the first transmission unit 31 to rotate along the first rotating direction R1 via the one-way input bearing 21, and the pulling rope 22 is adapted to be rolled up along the second rotating direction R2 by the reel 201.

Figure 6:
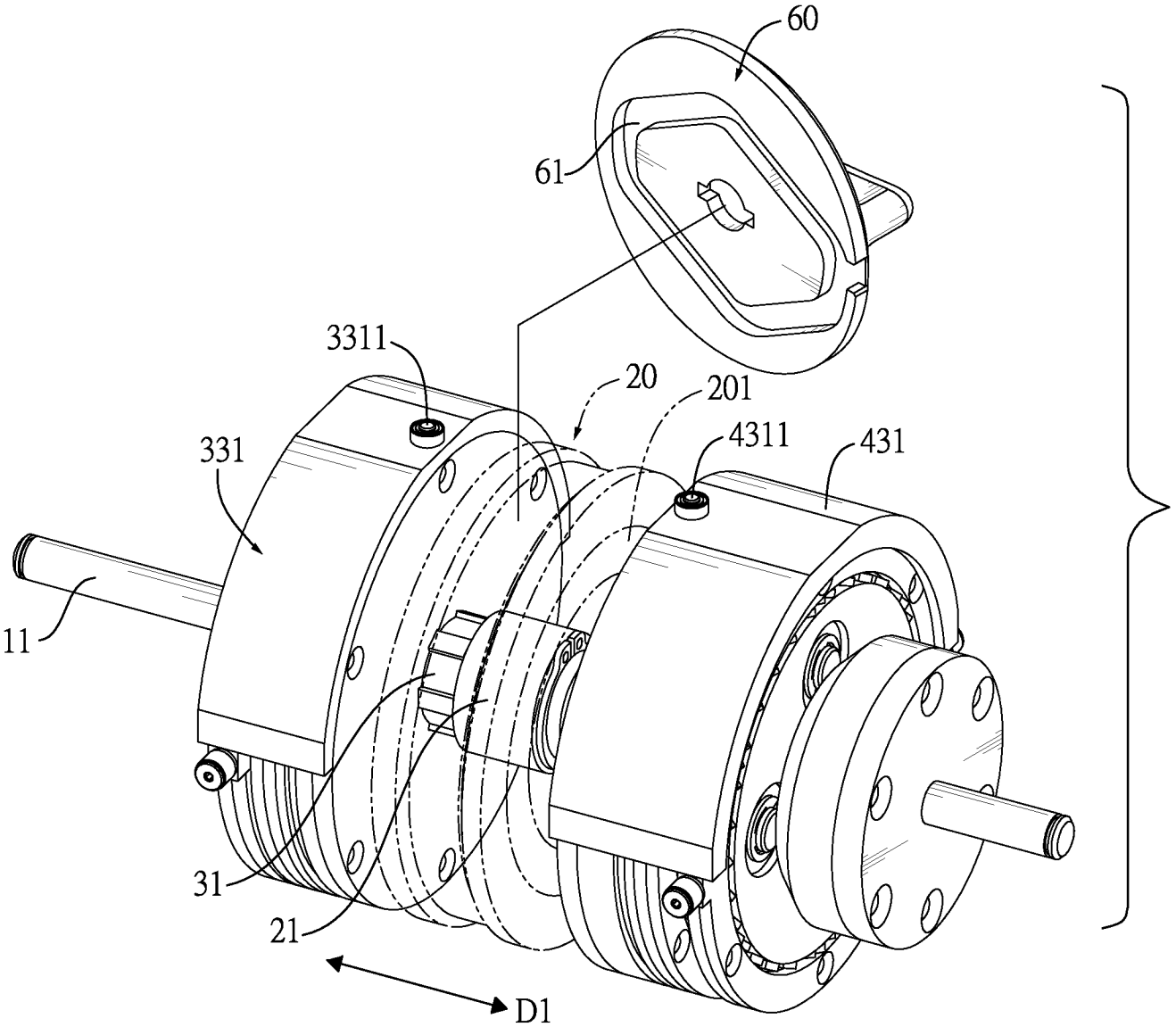
FIG. 6 is still another exploded view of the resistance supplier for weight training in FIG. 1, showing the switch dial, the first switching assembly and the second switching assembly.
Figure 7:
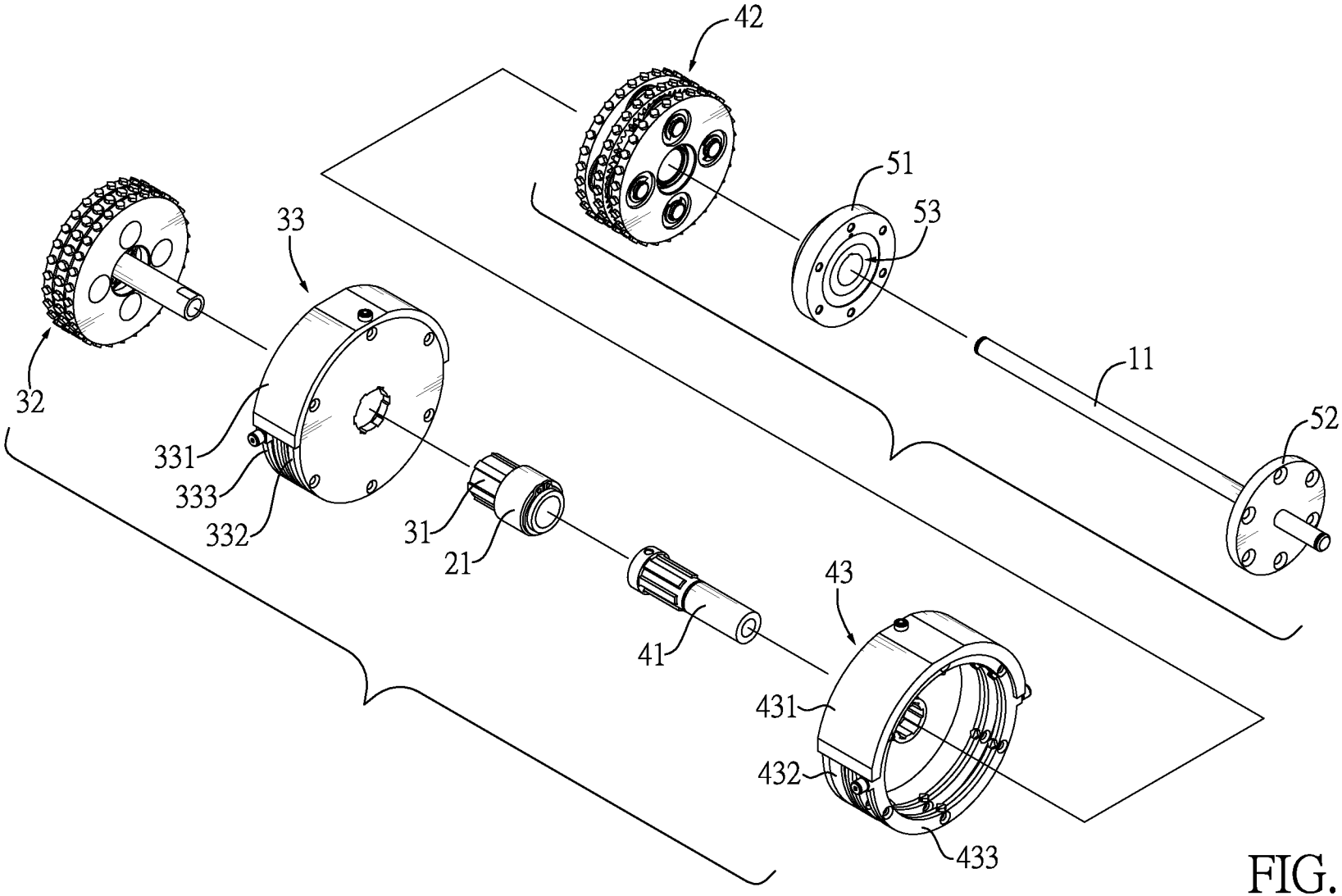
FIG. 7 is still another exploded view of the resistance supplier for weight training in FIG. 1, showing the first planetary gear set, the first switching assembly, the first transmission unit, the second transmission unit, the second planetary gear set, the second switching assembly, the output assembly, and the spindle.

With further reference to FIGS. 2, 6, and 7, the first transmission unit 31 is rotatably mounted around the spindle 11. Specifically, the first transmission unit 31 is capable of transmitting torque from the one-way input bearing 21 to the first switching assembly 33. The first transmission unit 31 is substantially a round tube, and an outer ring surface of the first transmission unit 31 protrudes with multiple teeth to engage with the first switching assembly 33. Additionally, in another embodiment, the first transmission unit 31 can also be implemented integrally with the input bearing inner ring, that is, in other words, the input bearing inner ring extends and is connected to the first switching assembly 33 to directly transmit torque.

Figure 8:
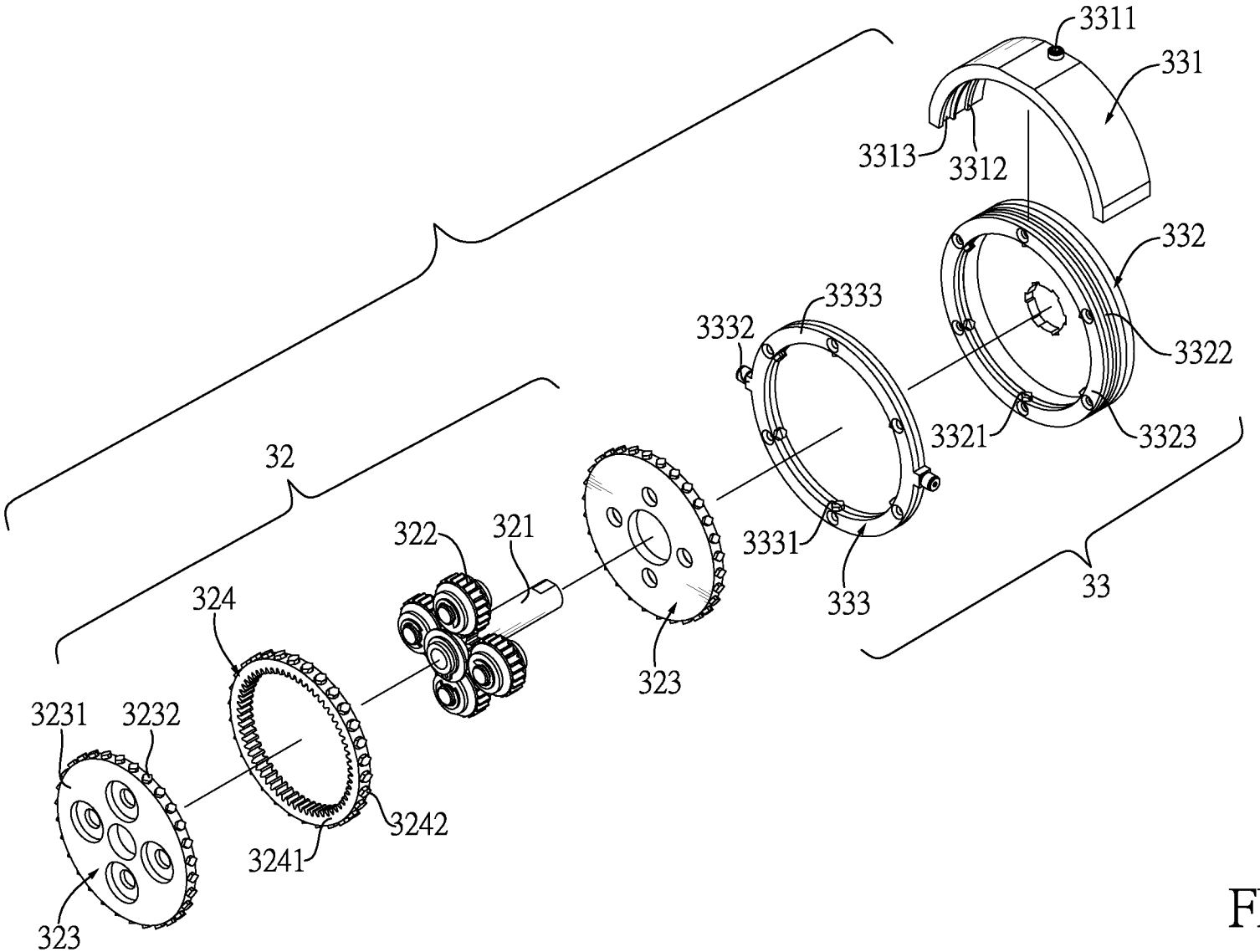
FIG. 8 is still another exploded view of the resistance supplier for weight training in FIG. 1, showing the first planetary gear set and the first switching assembly.

With further reference to FIGS. 7 and 8, the first planetary gear set 32 has a first sun gear 321, multiple first planet gears 322, two first planet carriers 323, and a first ring gear 324. The first sun gear 321 is rotatably mounted around the spindle 11. In this embodiment, the first sun gear 321 is rotatably mounted through the first transmission unit 31. In other words, the first transmission unit 31, the first sun gear 321, and the spindle 11 are sequentially rotatably mounted around one another. The first planet gears 322 engage with the first sun gear 321. Each of the first planet carriers 323 is connected to axles of the first planet gears 322, and the two first planet carriers 323 are respectively located in two sides of the first planet gears 322 in the axial direction. The first ring gear 324 engages with the first planet gears 322.

The first switching assembly 33 has a first switching unit 331, a first rotating unit 332, and a first fixing unit 333.

The first switching unit 331 is capable of moving along the axial direction D1 relative to the first transmission unit 31 and the first planetary gear set 32. A main purpose of the first switching unit 331 is to drive the first rotating unit 332 and the first fixing unit 333 to move together relative to the first planetary gear set 32, and move to two specific positions in the axial direction D1. Each of the two positions represents a gear, and each gear represents one specific rotation mode for the first planetary gear set 32. In other words, each of the two positions to which the first switching unit 331 is switched represents one respective reduction ratio.

The first rotating unit 332 is mounted around the first transmission unit 31, and the first transmission unit 31 is capable of driving the first rotating unit 332 to rotate. Specifically, the first rotating unit 332 has a round board segment and a through hole. The through hole is formed on a center of the round board segment, and a periphery of the through hole forms multiple notches for engaging with the first transmission unit 31. In the axial direction, the first switching unit 331 abuts two sides of the first rotating unit 332 and is capable of driving the first rotating unit 332 to move along the axial direction D1 relative to the first transmission unit 31 and the first planetary gear set 32. The first rotating unit 332 has at least one first driving segment 3321. The first driving segment 3321 is substantially a pillar and is adapted to drive parts of the first planetary gear set 32 to rotate. The first driving segment 3321 is capable of moving along with the first rotating unit 332 relative to the first planetary gear set 32 to connect to one of the two first planet carriers 323, or to connect to the first ring gear 324, i.e. either one of the abovementioned two positions.

The first fixing unit 333 is securely mounted on the first switching unit 331 and is capable of moving along with the first switching unit 331 relative to the first planetary gear set 32. The first fixing unit 333 has at least one first fixing segment 3331. The first fixing segment 3331 is substantially a pillar and is adapted to fix parts of the first planetary gear set 32. The first fixing segment 3331 is capable of moving along with the first fixing unit 333 relative to the first planetary gear set 32 to connect to and fix one of the two first planet carriers 323, or to connect to and fix the first ring gear 324, i.e. either one of the abovementioned two positions.

When the first driving segment 3321 abuts one of the two first planet carriers 323, the first fixing segment 3331 abuts and fixes the first ring gear 324, and the first rotating unit 332 is capable of driving said one of the two first planet carriers 323 to rotate via the first driving segment 3321, and then said one of the two first planet carriers 323 drives the first sun gear 321 to rotate. Specifically, the first switching unit 331 is switched to one of the two positions, one of the two gears, and one of the two reduction ratios.

When the first driving segment 3321 abuts the first ring gear 324, the first fixing segment 3331 abuts and fixes one of the two first planet carriers 323, and the first rotating unit 332 is capable of driving the first ring gear 324 to rotate via the first driving segment 3321, and then the first ring gear 324 drives the first sun gear 321 to rotate. Specifically, the first switching unit 331 is switched to the other one of the two positions, the other one of the two gears, and the other one of the two reduction ratios.

Figure 10:
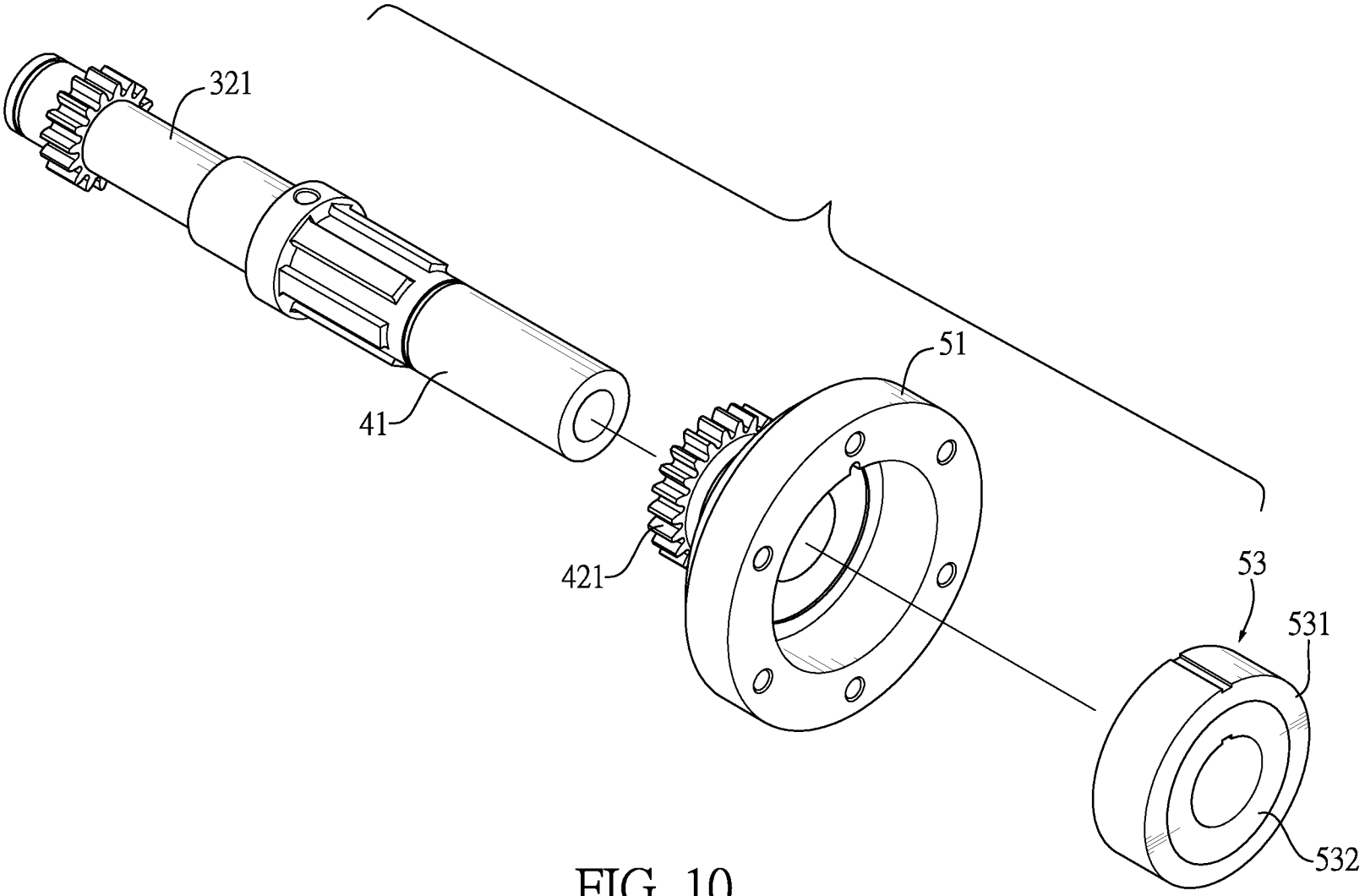
FIG. 10 is still another exploded view of the resistance supplier for weight training in FIG. 1, showing the first sun gear, the second transmission unit, the second sun gear, the driven unit, and the one-way output bearing.

With further reference to FIGS. 7 and 10, the second transmission unit 41 is rotatably mounted around the spindle 11 and is securely mounted on the first sun gear 321. The second transmission unit 41 is substantially a round tube, and an outer ring surface of the second transmission unit 41 protrudes with multiple teeth for engaging with the second switching assembly 43. Additionally, in this embodiment, the second transmission unit 41 is securely mounted on an end, which is mounted through the first transmission unit 31, of the first sun gear 321. But in another embodiment, the second transmission unit 41 can also be rotatably mounted through the first transmission unit 31 and be securely mounted on the first sun gear 321, which means the first sun gear 321 is not mounted through the first transmission unit 31. Specifically, the second transmission unit 41 is capable of transmitting torque from the first sun gear 321 to the second switching assembly 43. Additionally, the second transmission unit 41 can also be implemented integrally with the first sun gear 321, which means the first sun gear 321 extends and is connected to the second switching assembly 43 to directly transmit torque.

Figure 9:
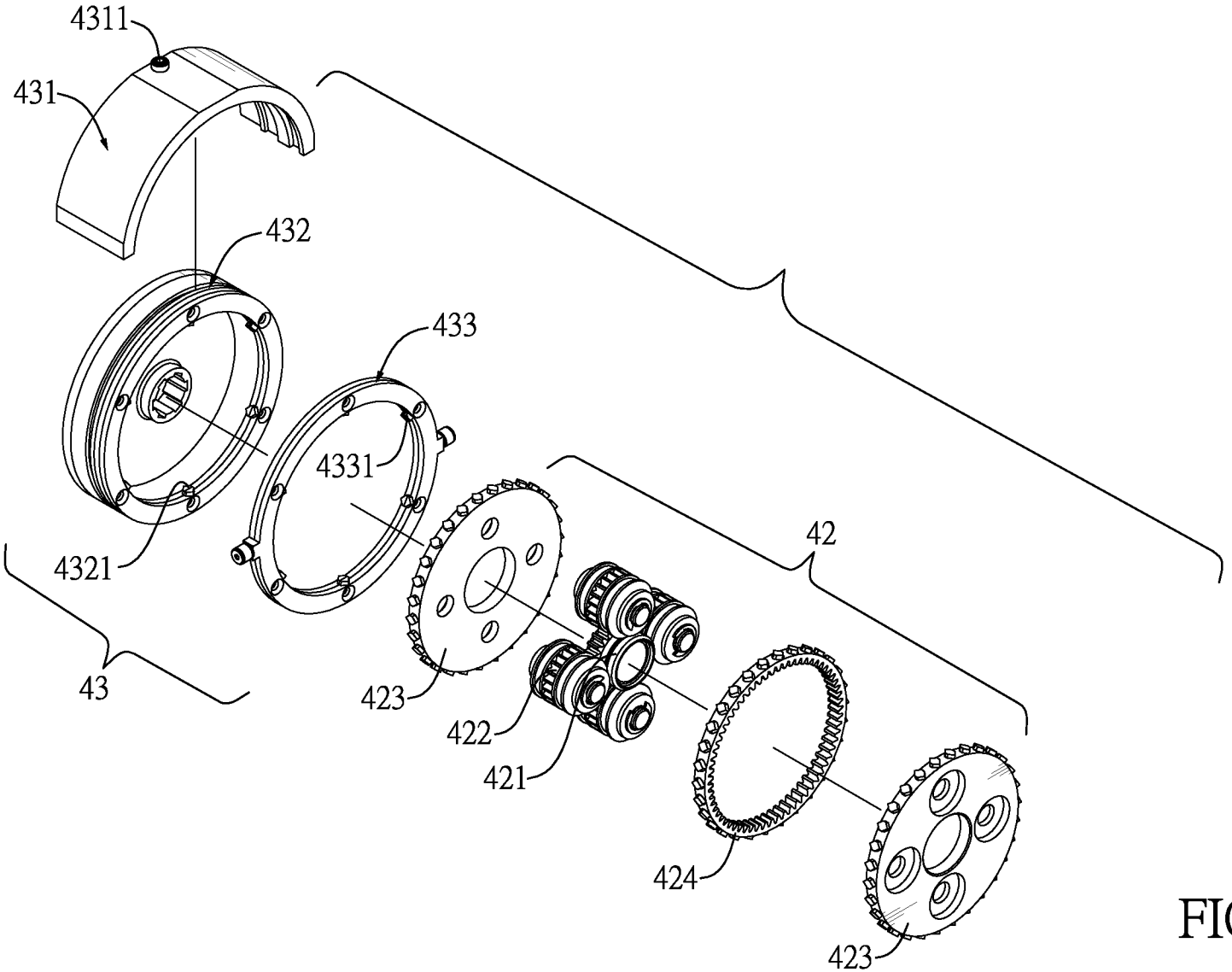
FIG. 9 is still another exploded view of the resistance supplier for weight training in FIG. 1, showing the second planetary gear set and the second switching assembly.

With further reference to FIGS. 7 and 9, the second planetary gear set 42 has a second sun gear 421, multiple second planet gears 422, two second planet carriers 423, and a second ring gear 424. The second sun gear 421 is rotatably mounted around the second transmission unit 41. In other words, the second transmission unit 41 is rotatably mounted through the second sun gear 421. The second planet gears 422 engage with the second sun gear 421. Each of the second planet carriers 423 is connected to axles of the second planet gears 422. In the axial direction, the two second planet carriers 423 are respectively located in two sides of the second planet gears 422. The second ring gear 424 engages with the second planet gears 422. The second switching assembly 43 has a second switching unit 431, a second rotating unit 432, and a second fixing unit 433.

The second switching unit 431 is capable of moving along the axial direction D1 relative to the second transmission unit 41 and the second planetary gear set 42. A main purpose of the second switching unit 431 is to drive the second rotating unit 432 and the second fixing unit 433 to move together relative to the second planetary gear set 42, and move to three specific positions in the axial direction D1. Each of the three positions represents a respective gear, and each gear represents one specific rotation mode for the second planetary gear set 42. In other words, each of the three positions to which the second switching unit 431 is switched represents one respective reduction ratio.

The second rotating unit 432 is mounted around the second transmission unit 41. The second transmission unit 41 is capable of driving the second rotating unit 432 to rotate. Specifically, the second rotating unit 432 has a round board segment and a through hole. The through hole is formed on a center of the round board segment, and a periphery of the through hole forms multiple notches for engaging with the second transmission unit 41. In the axial direction, the second switching unit 431 abuts two sides of the second rotating unit 432 and is capable of driving the second rotating unit 432 to move along the axial direction D1 relative to the second transmission unit 41 and the second planetary gear set 42. The second rotating unit 432 has at least one second driving segment 4321. The second driving segment 4321 is capable of moving along with the second rotating unit 432 relative to the second planetary gear set 42 to connect to one of the two second planet carriers 423, or to connect to the second ring gear 424, or not to connect to any one of the two second planet carriers 423 and the second ring gear 424.

The second fixing unit 433 is securely mounted on the second switching unit 431 and is capable of moving along with the second switching unit 431 relative to the second planetary gear set 42. The second fixing unit 433 has at least one second fixing segment 4331. The second fixing segment 4331 is capable of moving along with the second fixing unit 433 relative to the second planetary gear set 42 to connect to and fix one of the two second planet carriers 423, or to connect to and fix the second ring gear 424, or not to connect to any one of the two second planet carriers and the second ring gear, i.e. either one of the abovementioned three positions.

When the second driving segment 4321 abuts one of the two second planet carriers 423, the second fixing segment 4331 abuts and fixes the second ring gear 424, and the second rotating unit 432 is capable of driving said one of the two second planet carriers 423 to rotate via the second driving segment 4321, and then said one of the two second planet carriers 423 drives the second sun gear 421 to rotate. Specifically, the second switching unit 431 is switched to one of the three positions, one of the three gears, and one of the three reduction ratios. Additionally, during the aforementioned process, the first driving segment 3321 abuts one of the two first planet carriers 323.

When the second driving segment 4321 abuts the second ring gear 424, the second fixing segment 4331 abuts and fixes one of the two second planet carriers 423, and the second rotating unit 432 is capable of driving the second ring gear 424 to rotate via the second driving segment 4321, and then the second ring gear 424 drives the second sun gear 421 to rotate. Specifically, the second switching unit 431 is switched to the second one of the three positions, the second one of the three gears, and the second one of the three reduction ratios. Additionally, during the aforementioned process, the first driving segment 3321 abuts one of the two first planet carriers 323.

When the second driving segment 4321 does not abut any one of the two second planet carriers 423 and the second ring gear 424, the second fixing segment 4331 does not abut any one of the two second planet carriers 423 and the second ring gear 424, and the second rotating unit 432 does not drive any one of the two second planet carriers 423 and the second ring gear 424 to rotate via the second driving segment 4321. Specifically, the second switching unit 431 is switched to the third one the three positions, the third one the three gears, the third one the three reduction ratios. Additionally, in this gear, the second driving segment 4321, the second fixing segment 4331, the second ring gear 424, and the two second planet carriers 423 are located in five different positions in the axial direction D1 to stagger from each other such that the second switching unit 431 releases the second planetary gear set 42. Further, during the aforementioned process, the first driving segment 3321 abuts one of the two first planet carriers 323.

Figure 11:
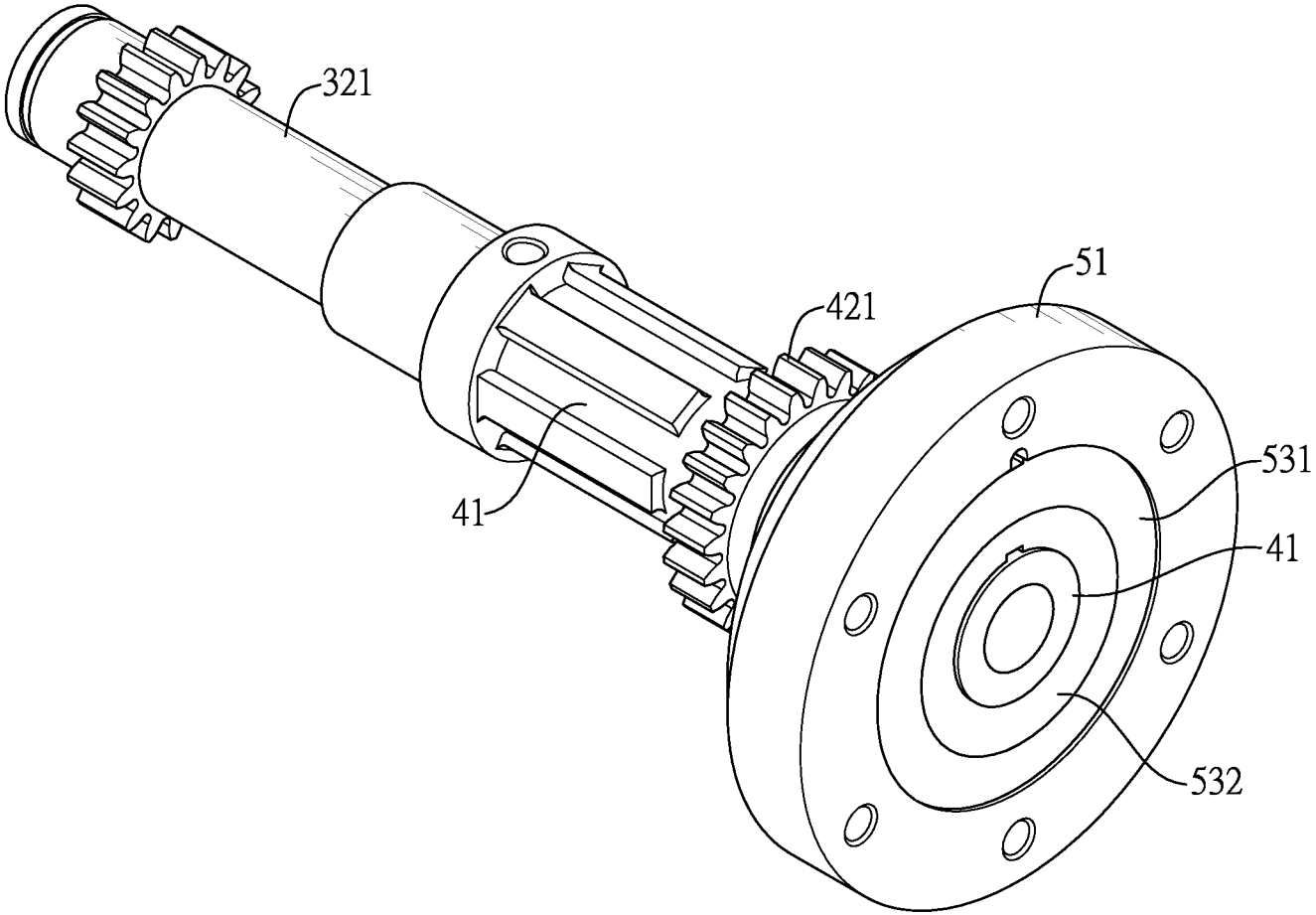
FIG. 11 is still another perspective view of the resistance supplier for weight training in FIG. 1, showing the first sun gear, the second transmission unit, the second sun gear, the driven unit, and the one-way output bearing.

With further reference to FIGS. 7, 10, and 11, the output assembly 50 has a driven unit 51, an output unit 52, and a one-way output bearing 53. The driven unit 51 is rotatably mounted on the second transmission unit 41 and is securely mounted on the second sun gear 421. The driven unit 51 is substantially a ring mounted around the one-way output bearing 53. A side surface of the driven unit 51 forms a connecting segment extending radially inward to securely mount on the second sun gear 421. The output unit 52 is securely mounted on the driven unit 51 and is securely mounted on the spindle 11. The output unit 52 is substantially a round board. A surface of the output unit 52 is securely mounted on another side surface, which is opposite to the connecting segment, of the driven unit 51. The spindle 11 is securely mounted through a center of the output unit 52. The one-way output bearing 53 has an output bearing outer ring 531 and an output bearing inner ring 532. The output bearing outer ring 531 is securely mounted on the driven unit 51. The output bearing inner ring 532 is securely mounted around the second transmission unit 41. The output bearing inner ring 532 is capable of driving the output bearing outer ring 531 and the driven unit 51 to rotate along the first rotating direction R1. The output bearing inner ring 532 is capable of rotating along the second rotating direction R2 relative to the output bearing outer ring 531. In other words, when the output bearing inner ring 532 rotates along the first rotating direction R1, the output bearing inner ring 532 buckles and drives the output bearing outer ring 531 to synchronously rotate along the first rotating direction R1. Conversely, when the output bearing inner ring 532 rotates along the second rotating direction R2, the output bearing outer ring 531 will be released such that the output bearing outer ring 531 will not rotate along with the output bearing inner ring 532.

With reference to FIGS. 10 and 11, on the main transmission path of torque:

1. The first sun gear 321 and the second transmission unit 41 are fixed together and rotate synchronously.

2. The second sun gear 421 and the driven unit 51 are fixed together and rotate synchronously, and both of the second sun gear 421 and the driven unit 51 are rotatably mounted around the second transmission unit 41.

3. The output bearing outer ring 531 and the driven unit 51 are fixed together and rotate synchronously. The second transmission unit 41 is rotatably mounted through the second sun gear 421 and is mounted in the driven unit 51 to be fixed to and rotate synchronously with the output bearing inner ring 532.

Additionally, in this embodiment, every two parts that are fixed together can also be implemented integrally, that is, one of any two fixed parts extends to form a segment that has the same function as the other part. For example, the second sun gear 421 can also extend to form a segment that has completely the same function as the driven unit 51. But in order to facilitate ease in manufacturing and assembling, two independent parts are fixed to each other in this embodiment.

Figure 5:
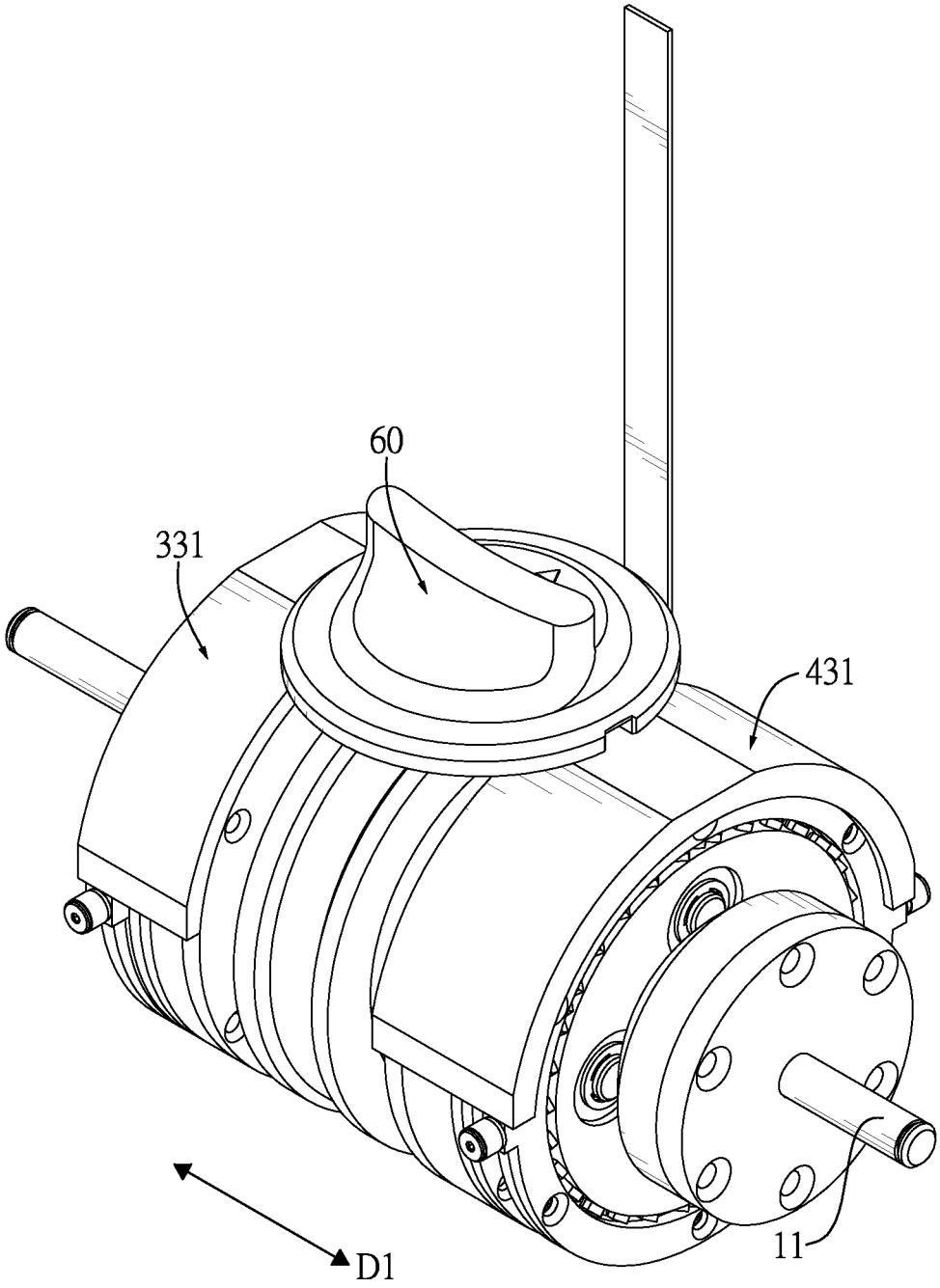
FIG. 5 is another perspective view of the resistance supplier for weight training in FIG. 1, showing the spindle, the input assembly, the first planetary gear set, the first switching assembly, the second planetary gear set, the second switching assembly, the output assembly, and the switch dial.

With further reference to FIGS. 5 and 6, in this embodiment, the specific implementation of moving the first switching unit 331 and the second switching unit 431 to switch gears is as follows.

In this embodiment, the first switching unit 331 has a first protrusion 3311, the second switching unit 431 has a second protrusion 4311, and the resistance supplier for weight training further has a switch dial 60. The switch dial 60 has a switch groove. The switch groove 61 is a non-circular ring. The first protrusion 3311 and the second protrusion 4311 are moveably mounted in the switch groove 61. Since the switch groove 61 is a non-circular ring, when the switch dial 60 is turned, the projection of the switch groove 61 on the spindle 11 will move relative to a rotation axis of the switch dial 60 along the axial direction D1, such that a side wall of the switch groove 61 will push and drive the first protrusion 3311 and the second protrusion 4311 to move along the axial direction D1. Therefore, when a user turns the switch dial 60, the switch dial 60 is capable of respectively moving the first switching unit 331 and the second switching unit 431 along the axial direction D1 via the switch groove 61, the first protrusion 3311, and the second protrusion 4311, thereby switching gears. However, in other embodiments, the way of moving the first switching unit 331 and the second switching unit 431 to switch gears is not limited to the abovementioned.

With the above structures, the present invention can be switched between three gears, that is, the present invention can provide three different training resistances with a fixed amount of weight 12. In each gear, the interlocking relationship between the abovementioned parts and the transmission path of torque are described as follows.

Figure 12:
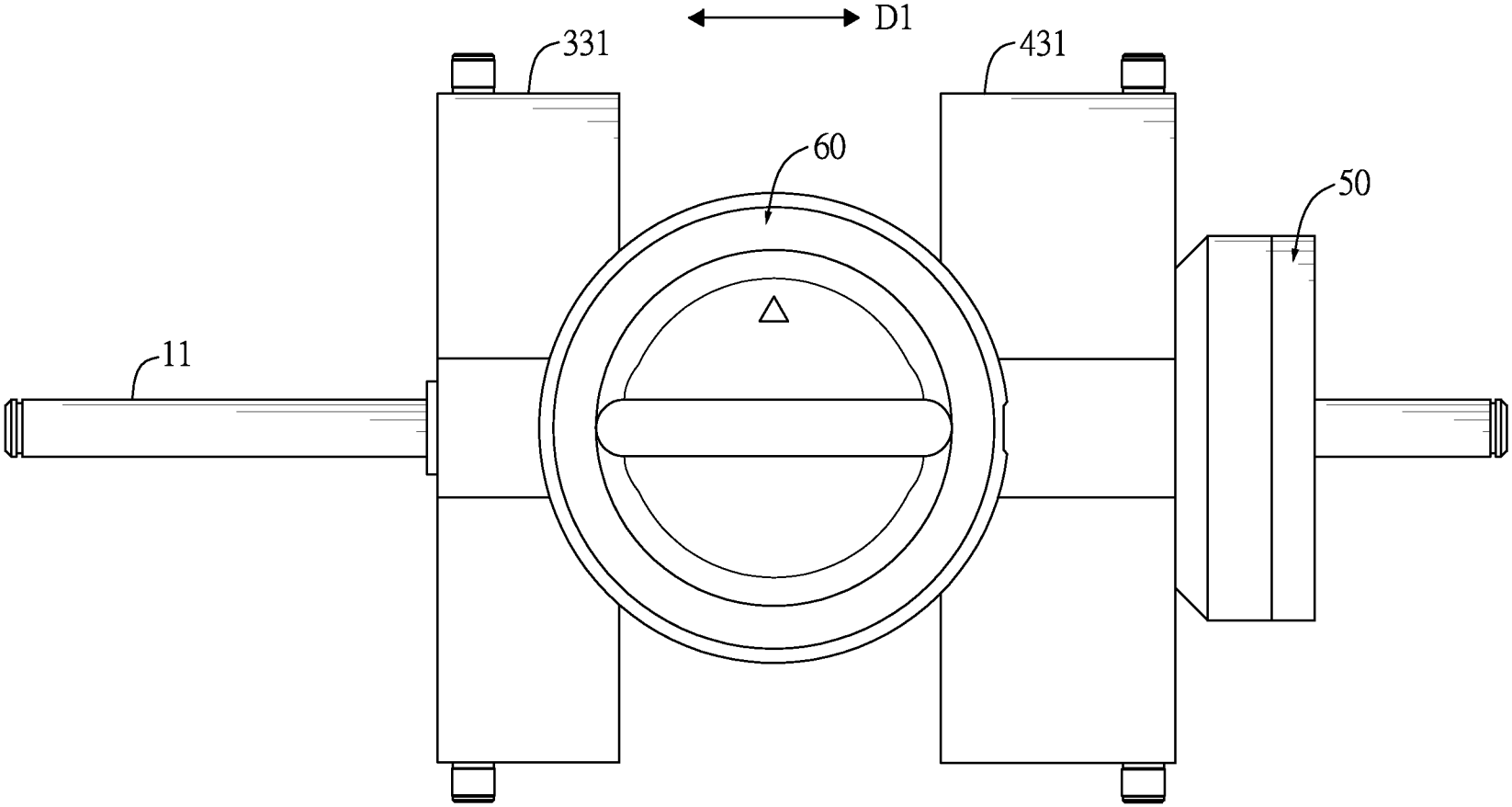
FIG. 12 is a top view of the resistance supplier for weight training in FIG. 1, showing positions of the first switching assembly, the second switching assembly, and the switch dial in gear 1.
Figure 13:
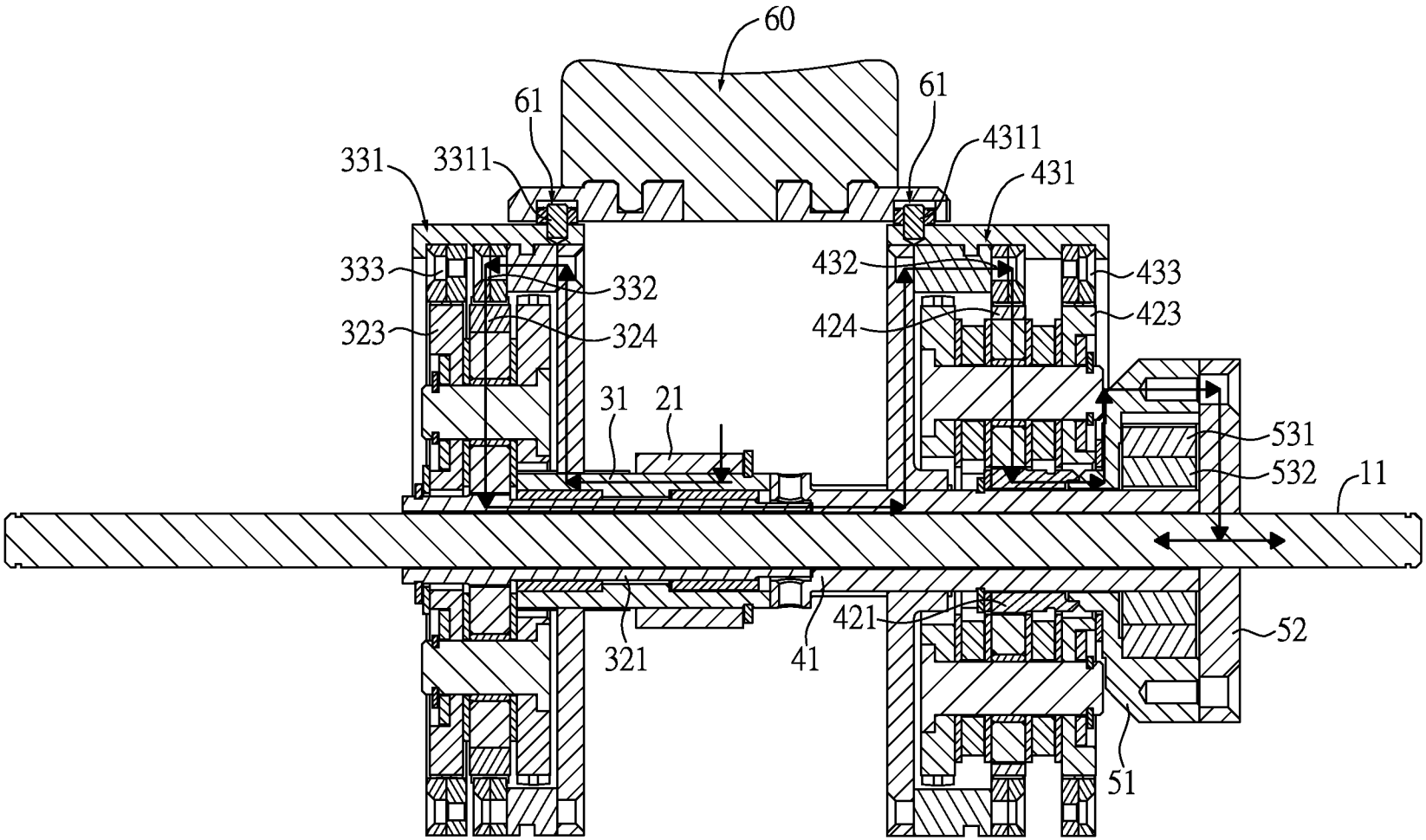
FIG. 13 is another side view in cross section of the resistance supplier for weight training in FIG. 1, showing the transmission path of torque in gear 1.

In the first gear (gear 1), with further reference to FIGS. 12 and 13, the switch dial 60 is rotated and drives the first protrusion 3311 and the second protrusion 4311 to move via the switch groove 61, and further drives the first switching unit 331 and the second switching unit 431 to move along the axial direction D1, such that eventually:

1. The first rotating unit 332 abuts the first ring gear 324 of the first planetary gear set 32 by the first driving segment 3321. The first fixing unit 333 abuts and fixes one of the two first planet carriers 323 of the first planetary gear set 32 by the first fixing segment 3331. In other words, the state of the first planetary gear set 32 is the first ring gear 324 set as input, the first planet carriers 323 fixed, and the first sun gear 321 set as output.

2. The second rotating unit 432 abuts the second ring gear 424 of the second planetary gear set 42 by the second driving segment 4321. The second fixing unit 433 abuts and fixes one of the two second planet carriers 423 of the second planetary gear set 42 by the second fixing segment 4331. In other words, the state of the second planetary gear set 42 is the second ring gear 424 set as input, the second planet carriers 423 fixed, and the second sun gear 421 set as output.

By this, when the user pulls the pulling rope 22, the pulling rope 22 first drives the input bearing outer ring of the one-way input bearing 21 to rotate along the first rotating direction R1. Then, the input bearing outer ring buckles and drives the input bearing inner ring to rotate along the first rotating direction R1. And then the first transmission unit 31, which is fixed on the input bearing inner ring of the input bearing, rotates along the first rotating direction R1 in synchronization with the input bearing inner ring. Subsequently, the first transmission unit 31 drives the first rotating unit 332 to rotate along the first rotating direction R1, and the first driving segment 3321 rotates along with the first rotating unit 332 to drive the first ring gear 324 to rotate along the first rotating direction R1. At this time, because the first planet carrier 323 is abutted and fixed by the first fixing unit 333 with the first fixing segment 3331, the first sun gear 321 rotates along the second rotating direction R2 (This is an inherent characteristic of the planetary gear set and will not be described in detail). Next, the second transmission unit 41, which is fixed to the first sun gear 321, rotates in synchronization with the first sun gear 321 along the second rotating direction R2. Then, the second transmission unit 41 drives the second rotating unit 432 to rotate along the second rotating direction R2, and the second driving segment 4321 rotates along with the second rotating unit 432 to drive the second ring gear 424 to rotate along the second rotating direction R2. At this time, since the second planet carrier 423 is abutted and fixed by the second fixing segment 4331 of the second fixing unit 433, the second sun gear 421 rotates along the first rotating direction R1 (This is an inherent characteristic of the planetary gear and will not be described in detail). Subsequently, the driven unit 51, which is fixed to the second sun gear 421, also synchronously rotates along the first rotating direction R1 and drives the spindle 11 to rotate along the first rotating direction R1 by the output unit 52, which is fixed to the driven unit 51. Finally, the torque is transmitted to the weight 12 to drive the weight 12 to rotate.

Most importantly, the torque input by the user is reduced by the reduction ratio of the first planetary gear set 32 and the second planetary gear set 42 (The extent of reduction depends on the final reduction ratio multiplied by the two planetary gear sets), so it is necessary to apply a torque greater than an original torque that is not reduced by the reduction ratio but rotates the weight 12 to rotate the weight 12, thereby achieving the purpose of training. In gear 1, it should be noted that the second transmission unit 41 will drive the output bearing inner ring 532 to rotate synchronously along the second rotating direction R2, and the driven unit 51 will drive the output bearing outer ring 531 to rotate along the first rotating R1, so the output bearing inner ring 532 rotates along the second rotating direction R2 relative to the output bearing outer ring 531, that is, the one-way output bearing 53 is released, so no interference occurs.

Figure 14:
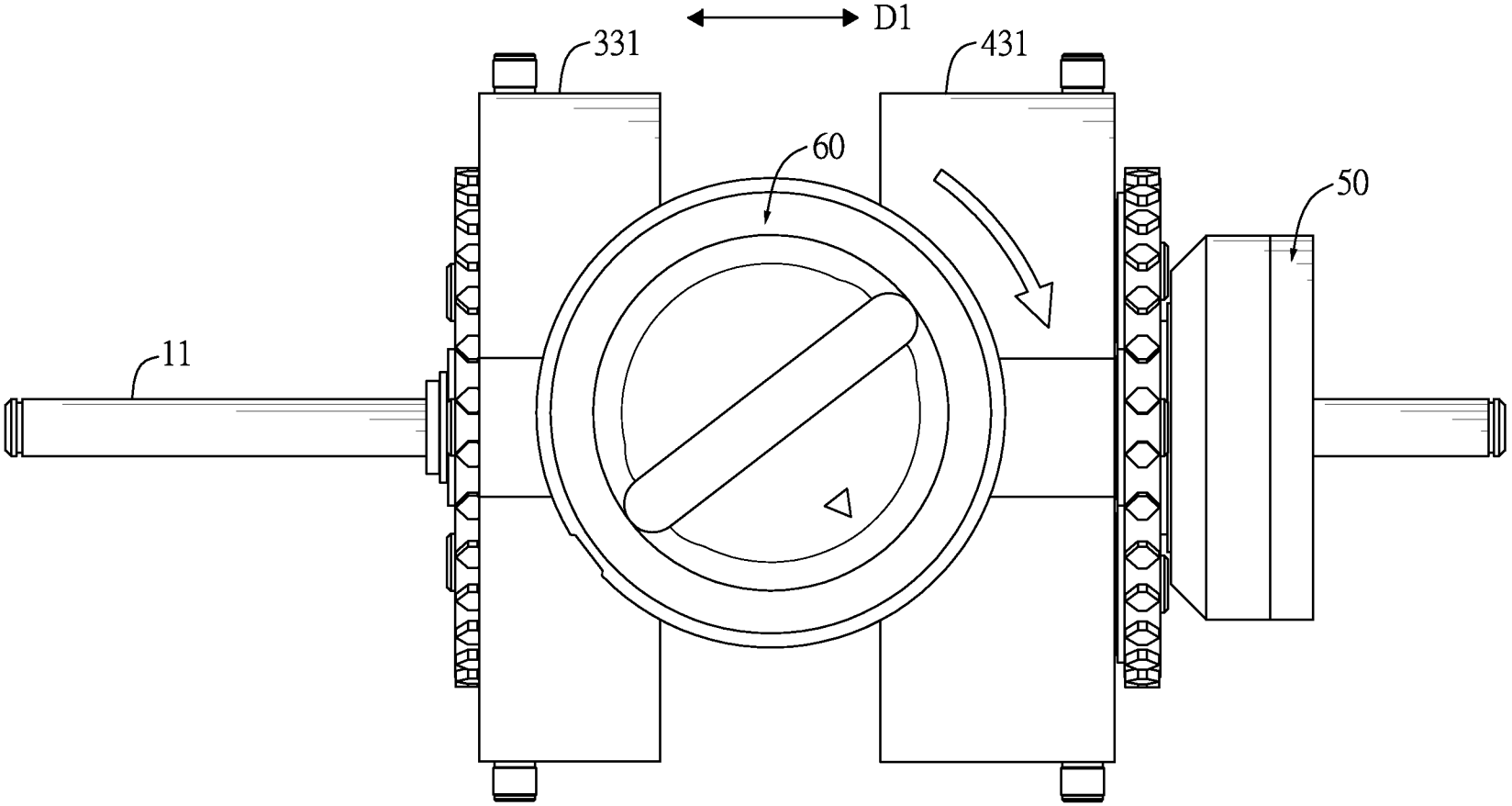
FIG. 14 is another top view of the resistance supplier for weight training in FIG. 1, showing positions of the first switching assembly, the second switching assembly, and the switch dial in gear 2.
Figure 15:
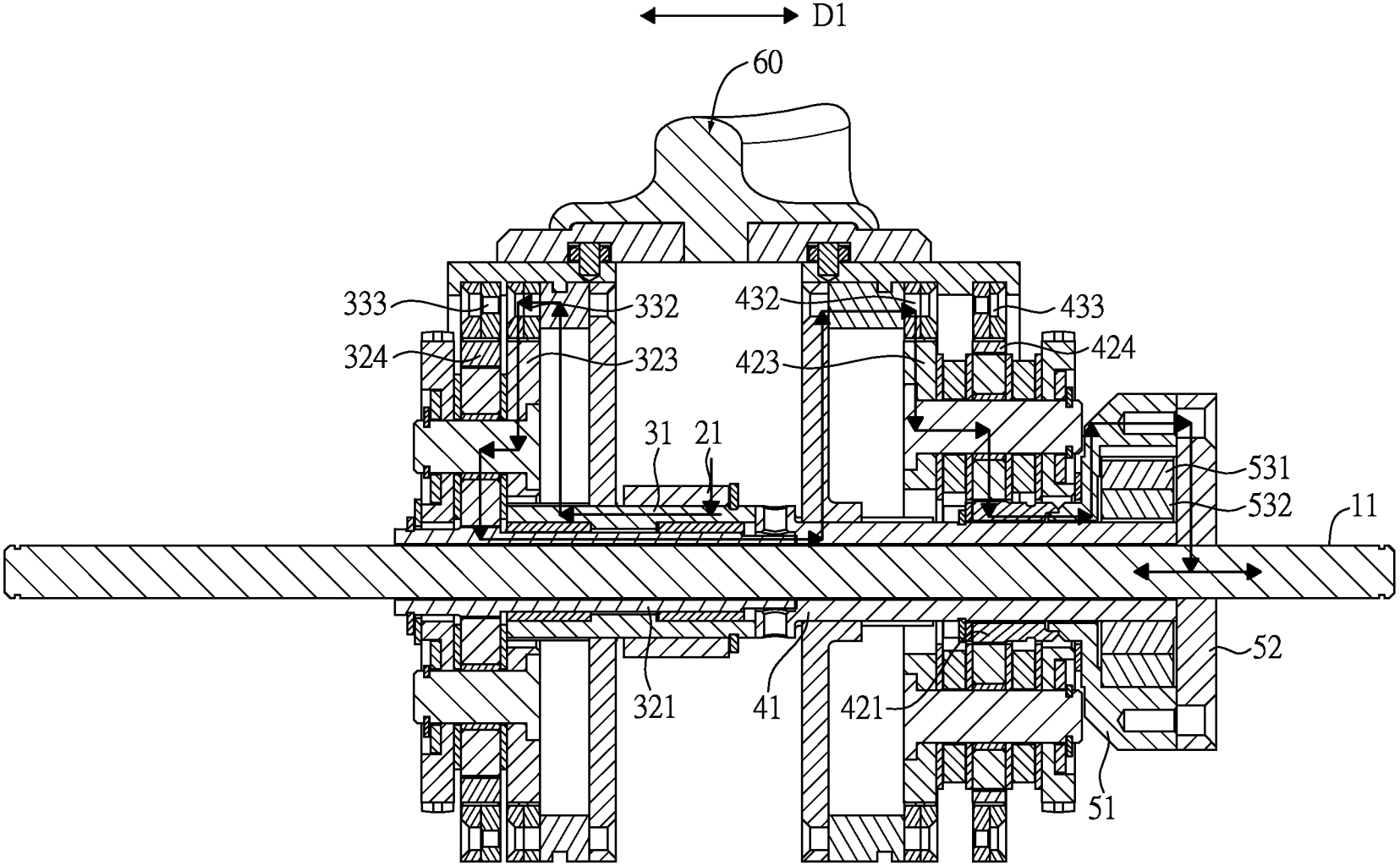
FIG. 15 is still another side view in cross section of the resistance supplier for weight training in FIG. 1, showing the transmission path of torque in gear 2.

In the second gear (gear 2), with further reference to FIGS. 14 and 15, the switch dial 60 is rotated and drives the first protrusion 3311 and the second protrusion 4311 to move via the switch groove 61, and further drives the first switching unit 331 and the second switching unit 431 to move along the axial direction D1, such that eventually:

1. The first rotating unit 332 abuts one of the two first planet carriers 323 of the first planetary gear set 32 by the first driving segment 3321. The first fixing unit 333 abuts and fixes the first ring gear 324 of the first planetary gear set 32 by the first fixing segment 3331. In other words, the state of the first planetary gear set 32 is the first planet carrier 323 set as input, the first ring gear 324 fixed, and the first sun gear 321 set as output.

2. The second rotating unit 432 abuts one of the two second planet carriers 423 of the second planetary gear set 42 by the second driving segment 4321. The second fixing unit 433 abuts and fixes the second ring gear 424 of the second planetary gear set 42 by the second fixing segment 4331. In other words, the state of the second planetary gear set 42 is the second planet carriers 423 set as input, the second ring gear 424 fixed, and the second sun gear 421 set as output.

By this, when the user pulls the pulling rope 22, the pulling rope 22 first drives the input bearing outer ring of the one-way input bearing 21 to rotate along the first rotating direction R1. Then, the input bearing outer ring buckles and drives the input bearing inner ring to rotate along the first rotating direction R1. And then the first transmission unit 31, which is fixed on the input bearing inner ring of the input bearing, rotates along the first rotating direction R1 in synchronization with the input bearing inner ring. Subsequently, the first transmission unit 31 drives the first rotating unit 332 to rotate along the first rotating direction R1, and the first driving segment 3321 rotates along with the first rotating unit 332 to drive the first planet carrier 323 to rotate along the first rotating direction R1. At this time, because the first ring gear 324 is abutted and fixed by the first fixing unit 333 with the first fixing segment 3331, the first sun gear 321 rotates along the second rotating direction R1 (This is an inherent characteristic of the planetary gear set and will not be described in detail). Next, the second transmission unit 41, which is fixed to the first sun gear 321, rotates in synchronization with the first sun gear 321 along the second rotating direction R1. Then, the second transmission unit 41 drives the second rotating unit 432 to rotate along the second rotating direction R1, and the second driving segment 4321 rotates along with the second rotating unit 432 to drive the second ring gear 424 to rotate along the second rotating direction R1. At this time, since the second ring gear 424 is abutted and fixed by the second fixing segment 4331 of the second fixing unit 433, the second sun gear 421 rotates along the first rotating direction R1 (This is an inherent characteristic of the planetary gear and will not be described in detail). Subsequently, the driven unit 51, which is fixed to the second sun gear 421, also synchronously rotates along the first rotating direction R1 and drives the spindle 11 to rotate along the first rotating direction R1 by the output unit 52, which is fixed to the driven unit 51. Finally, the torque is transmitted to the weight 12 to drive the weight 12 to rotate, and the torque input by the user is reduced by the reduction ratio of the first planetary gear set 32 and second planetary gear set 42 (The extent of reduction depends on the final reduction ratio multiplied by the two planetary gear sets).

In gear 2, it should be noted that the second transmission unit 41 will drive the output bearing inner ring 532 to rotate synchronously along the second rotating direction R1, and the driven unit 51 will drive the output bearing outer ring 531 to rotate along the first rotating R1. In this situation, a speed at which the output bearing outer ring 531 rotates along the first rotating direction R1 is higher than a speed at which the output bearing inner ring 532 rotates along the first rotating direction R1, so the output bearing inner ring 532 actually rotates along the second rotating direction R2 relative to the output bearing outer ring 531, that is, the one-way output bearing 53 is released, so no interference occurs.

Figure 16:
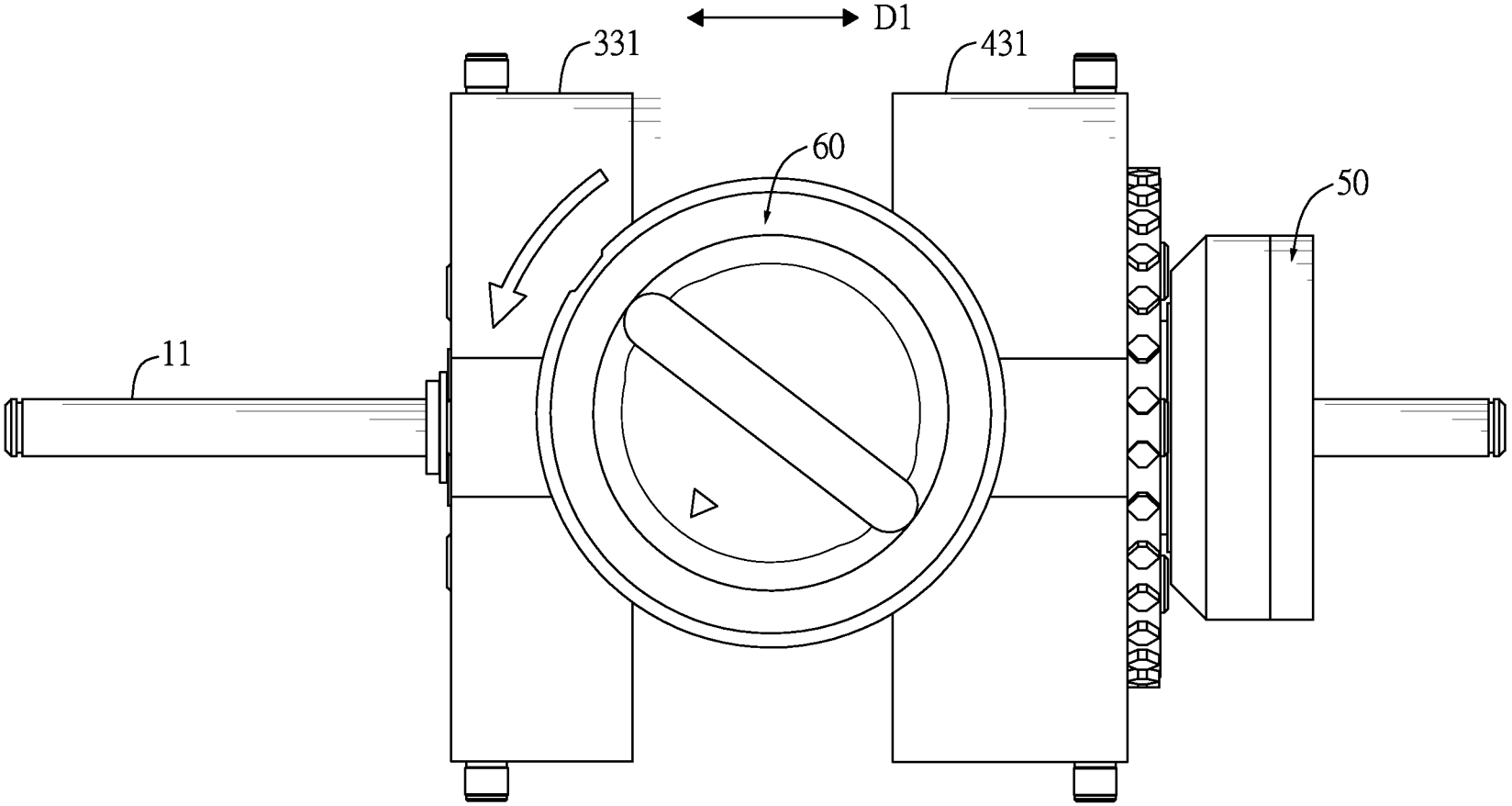
FIG. 16 is still another top view of the resistance supplier for weight training in FIG. 1, showing positions of the first switching assembly, the second switching assembly, and the switch dial in gear 3.
Figure 17:
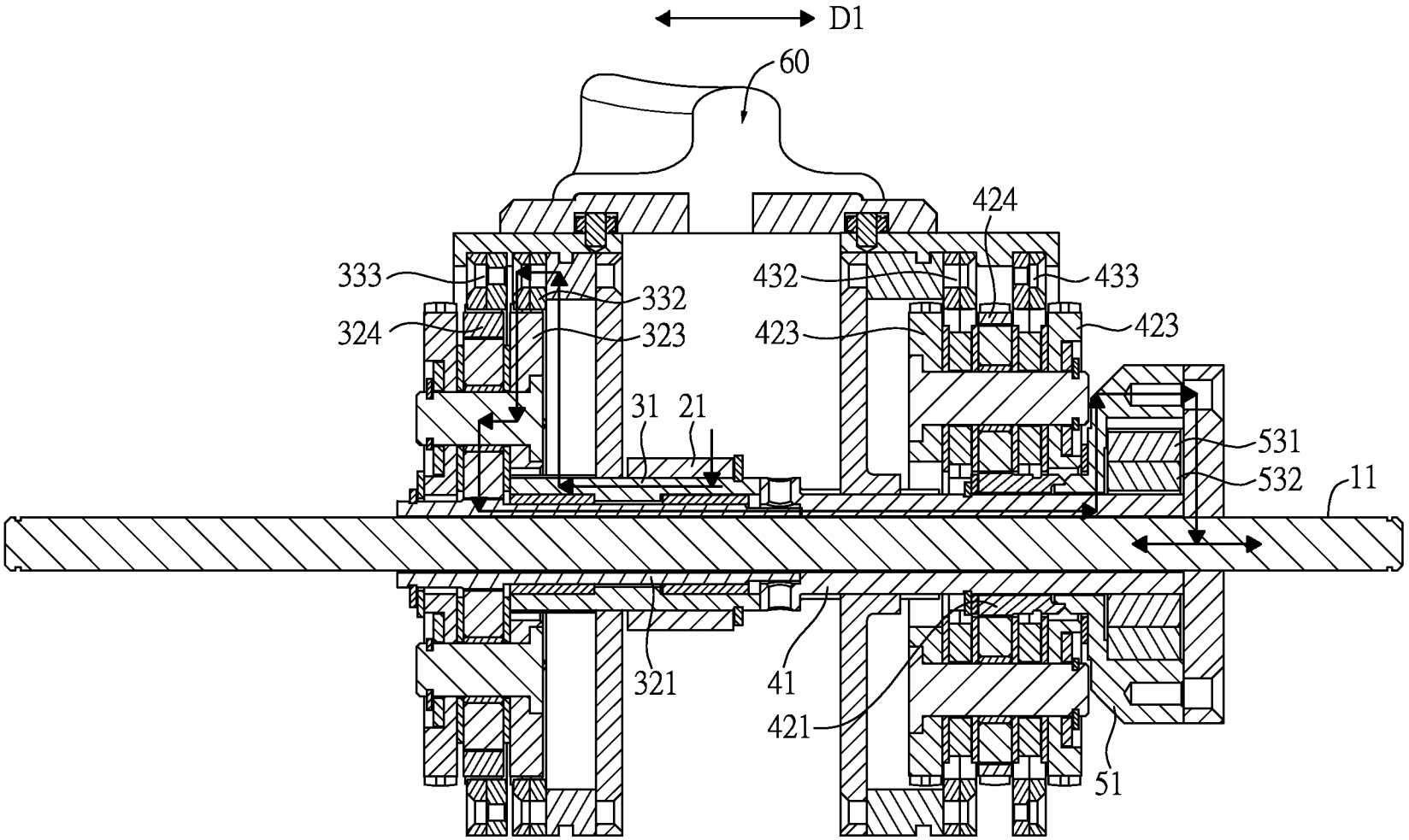
FIG. 17 is still another side view in cross section of the resistance supplier for weight training in FIG. 1, showing the transmission path of torque in gear 3.

In third gear (gear 3), with further reference to FIGS. 16 and 17, the switch dial 60 is rotated and drives the first protrusion 3311 and the second protrusion 4311 to move via the switch groove 61, and further drives the first switching unit 331 and the second switching unit 431 to move along the axial direction D1, such that eventually:

1. The first rotating unit 332 abuts one of the two first planet carriers 323 of the first planetary gear set 32 by the first driving segment 3321. The first fixing unit 333 abuts and fixes the first ring gear 324 of the first planetary gear set 32 by the first fixing segment 3331. In other words, the state of the first planetary gear set 32 is the first planet carrier 323 set as input, the first ring gear 324 fixed, and the first sun gear 321 set as output.

2. The second driving segment 4321 of the second rotating unit 432 does not abut any one of the two second planet carriers 423 and the second ring gear 424 of the second planetary gear set 42, and the second fixing segment 4331 of the second fixing unit 433 does not abut and does not fix any one of the two second planet carriers 423 and the second ring gear 424 of the second planetary gear set 42. In other words, the state of the second planetary gear set 42 is the second planetary gear set 42 released, the second ring gear 424 released, and the second sun gear 421 released.

By this, when the user pulls the pulling rope 22, the pulling rope 22 first drives the input bearing outer ring of the one-way input bearing 21 to rotate along the first rotating direction R1. Then, the input bearing outer ring buckles and drives the input bearing inner ring to rotate along the first rotating direction R1. And then the first transmission unit 31, which is fixed on the input bearing inner ring of the input bearing, rotates along the first rotating direction R1 in synchronization with the input bearing inner ring. Subsequently, the first transmission unit 31 drives the first rotating unit 332 to rotate along the first rotating direction R1, and the first driving segment 3321 rotates along with the first rotating unit 332 to drive the first planet carrier 323 to rotate along the first rotating direction R1. At this time, because the first ring gear 324 is abutted and fixed by the first fixing unit 333 with the first fixing segment 3331, the first sun gear 321 rotates along the second rotating direction R1 (This is an inherent characteristic of the planetary gear set and will not be described in detail). Next, the second transmission unit 41, which is fixed to the first sun gear 321, rotates in synchronization with the first sun gear 321 along the second rotating direction R1. Then, since the second planetary gear set 42 is completely released by the second switching assembly 43, the second transmission unit 41 transmits the torque directly to the output bearing inner ring 532 without transmitting via the second planetary gear set 42. Therefore the second transmission unit 41 drives the output bearing inner ring 532 to rotate along the first rotating direction R1, and the output bearing inner ring 532 further drives the output bearing outer ring 531 to rotate along the first rotating direction R1. Next, the output bearing outer ring 531 drives the driven unit 51 to rotate along the first rotating direction R1, and the driven unit 51 drives the spindle 11 to rotate along the first rotating direction R1 by the output unit 52, which is fixed to the driven unit 51.

Finally, the torque is transmitted to the weight 12 to drive the weight 12 to rotate, and the torque input by the user is reduced by only the reduction ratio of the first planetary gear set 32 (Since the second planetary gear set 42 is released, no reduction ratio is provided from the second planetary gear set 42). In other words, the one-way output bearing 53 is engaged in gear 3, which means the output bearing outer ring 531 and the output bearing inner ring 532 engage with each other instead of releasing each other, and the torque is transmitted through the output bearing outer ring 531 and the output bearing inner ring 532.

In gear 3, it should be noted that when the output bearing outer ring 531 drives the driven unit 51 to rotate along the first rotating direction R1, the driven unit 51 synchronously drives the second sun gear 421, which is fixed with the driven unit 51, to rotate along the first rotating direction R1; but in this case, since the second planetary gear set 42 is released, even though the driven unit 51 drives the second sun gear 421 to rotate, the second sun gear 421 will not reversely drive the second switching assembly 43 to rotate via the second planet carrier 423 or the second ring gear 424, thereby applying no torque to the second transmission unit 41. As a result, no interference occurs.

Additionally, in this embodiment, the spindle 11 is securely mounted on only the output unit 52 and is driven to rotate only by the output unit 52. In other words, any other part described above is rotatably mounted around the spindle 11 but is not capable of applying force directly to the spindle 11. Further, the output unit 52 is securely mounted on only the driven unit 51 and is driven to rotate only by the driven unit 51, and the driven unit 51 is securely mounted on both the second sun gear 421 and the output bearing outer ring 531, thereby capable of being driven by both the second sun gear 421 and the output bearing outer ring 531. Therefore, the torque applied by the user will be eventually transmitted through two paths. One of the two paths is through the second sun gear 421 to the driven unit 51 to drive the spindle 11, and the other one of the two paths is through the output bearing outer ring 531 to the driven unit 51 to drive the spindle 11, and via which path to transmit the torque is determined by the gear of the two planetary gear sets, that is, determined by the positions of the two switching assemblies in the axial direction D1 (which determine the input gear and the output gear from the ring gears and the planet carriers). Therefore, in order to prevent interference of the two paths, the two planetary gear sets should cooperate as follows.

1. When the state of the second planetary gear set 42 is the second ring gear 424 fixed and the second planet carrier 423 set as input, the state of the first planetary gear set 32 must be the first ring gear 324 fixed and the first planet carrier 323 set as input.

If the state of the first planetary gear set 32 is the first planet carrier 323 fixed and the first ring gear 324 set as input in this case, after a series of transmissions, the output bearing inner ring 532 will be driven to rotate along the second rotating direction R2 by the second transmission unit 41. According to the above, the output bearing inner ring 532 should be allowed to rotate along the second rotating direction R2 relative to the output bearing outer ring 531. However, in this case, the output bearing outer ring 531 will be driven to rotate along the second rotating direction R2 at a faster speed by the second sun gear 421, and that makes the output bearing inner ring 532 actually rotate along the first rotating direction R1 relative to the output bearing outer ring 531. As a result, the output bearing inner ring 532 and the output bearing outer ring 531 are fixed to each other but are driven by different parts to rotate at different speeds, which leads to interference and makes the whole system inoperable.

2. When the state of the second planetary gear set 42 is the second planet carrier 423 fixed and the second ring gear 424 set as input, the state of the first planetary gear set 32 must be the first planet carrier 323 fixed and the first ring gear 324 set as input.

If the state of the first planetary gear set 32 is the first ring gear 324 fixed and the first planet carrier 323 set as input in this case, after a series of transmissions, the output bearing inner ring 532 will be driven to rotate along the first rotating direction R1 by the second transmission unit 41. According to the above, the output bearing inner ring 532 should buckle and drive the output bearing outer ring 531 to rotate along the first rotating direction R1. However, in this case, the output bearing outer ring 531 will be driven to rotate along the second rotating direction R2 by the second sun gear 421. As a result, the output bearing inner ring 532 and the output bearing outer ring 531 are fixed to each other but are driven by different parts to rotate reverse to each other, which leads to interference and makes the whole system inoperable.

3. When the second planetary gear set 42 is released, the state of the first planetary gear set 32 must be the first ring gear 324 fixed and the first planet carrier 323 set as input.

In this case, because the second planetary gear set 42 is not engaged during the transmission of the torque, the second transmission unit 41 transmits the torque directly through the output bearing inner ring 532 to the output bearing outer ring 531 to drive the driven unit 51. However, if the state of the first planetary gear set 32 is the first planet carrier 323 fixed and the first ring gear 324 set as input in this case, the second transmission unit 41 will rotate along the second rotating direction R2 and drives the output bearing inner ring 532 to rotate along the second rotating direction R2 relative to the output bearing outer ring 531. According to the above, the output bearing inner ring 532 will be idling, and therefore the one-way output bearing 53 will be released and will not be able to drive the driven unit 51 to drive the spindle 11. Eventually, though no interference occurs, the whole system will still be inoperable.

In summary, though the first switching assembly 33 offers two gears and the second switching assembly 43 offers three gears, due to the above interference and idling situation, the two planetary gear sets are capable of cooperating to offer three gears, which are three reduction ratios. Additionally, since the gears of the first switching unit 331 and the second switching unit 431 must cooperate with each other to avoid interference or idling, the shape of the ring of the switch groove 61 and the rotation degree of the switch dial 60 must match the specific position of the first switching unit 331 and the second switching unit 431 in the axial direction D1.

Furthermore, with further reference to FIGS. 7 and 8, the structural connection between the first switching unit 331 and the first rotating unit 332 of the first switching assembly 33 in this embodiment is as follows. The first rotating unit 332 further has a first ring groove 3322. The first switching unit 331 is in the shape of a half circle, is fixed in the first rotating direction R1 and the second rotating direction R2, is only capable of moving along the axial direction D1, and further has a first rib 3312. The first ring groove 3322 is formed on an outer ring surface of the first rotating unit 332. The first rib 3312 is moveably mounted in the first ring groove 3322 so that the first rotating unit 332 is capable of rotating along the first rotating direction R1 or the second rotating direction R2 relative to the first switching unit 331. In the axial direction, the first rib 3312 abuts the first ring groove 3322 such that the first switching unit 331 is capable of driving the first rotating unit 332 to move along the axial direction D1 via the first rib 3312 and the first ring groove 3322. Additionally, in this embodiment, a structural connection between the second switching unit 431 and the second rotating unit 432 of the second switching assembly 43 is completely the same as a structural connection between the first switching unit 331 and the first rotating unit 332 of the first switching assembly 33 disclosed above, but in another embodiment, the configuration of the first switching assembly 33 and the configuration of the second switching assembly 43 are not limited thereto.

Moreover, with further reference to FIGS. 7 and 8, the structural connection between the first switching unit 331 and the first fixing unit 333 of the first switching assembly 33 in this embodiment is as follows. The first switching unit 331 further has a first position limiting groove 3313. The first fixing unit 333 further has two first position limiting segments 3332. The first fixing unit 333 is mounted in the first position limiting groove 3313 and the first position limiting groove 3313 abuts two sides of the first fixing unit 333 in the axial direction D1 such that the first fixing unit 333 is fixed relative to the first switching unit 331 in the axial direction D1. The two first position limiting segments 3332 protrude from a periphery of the first fixing unit 333, and the two first position limiting segments 3332 respectively abut two ends of the first switching unit 331 such that the first fixing unit 333 is fixed relative to the first switching unit 331 in both the first rotating direction R1 and the second rotating direction R2. Additionally, in this embodiment, a structural connection between the second switching unit 431 and the second fixing unit 433 of the second switching assembly 43 is completely the same as a structural connection between the first switching unit 331 and the first fixing unit 333 of the first switching assembly 33 disclosed above, but in another embodiment, the configuration of the first switching assembly 33 and the configuration of the second switching assembly 43 are not limited thereto.

Further, with further reference to FIGS. 7 and 8, the specific configuration and operation of the first rotating unit 332 and the first fixing unit 333 of the first switching assembly 33 respectively driving or fixing the first planet carrier 323 and the first ring gear 324 in this embodiment are as follows. The first rotating unit 332 further has a first rotating ring segment 3323. The first fixing unit 333 further has a first fixing ring segment 3333. Each of the first planet carriers 323 has a first planet carrier body segment 3231 and multiple first planet carrier protrusion segments 3232. The first ring gear 324 has a first ring gear body segment 3241 and multiple first ring gear protrusion segments 3242.

The first driving segment 3321 is formed on the first rotating ring segment 3323 and extends radially inward. The first fixing segment 3331 is formed on the first fixing ring segment 3333 and extends radially inward. The first planet carrier body segment 3231 is connected to the axles of the first planet gears 322. The first planet carrier protrusion segments 3232 are formed on an outer ring surface of the first planet carrier body segment 3231 and extend radially outward. Each first driving segment 3321 is selectively located between any two adjacent ones of the first planet carrier protrusion segments 3232 to abut and drive the first planet carrier 323 in the corresponding gear. Each first fixing segment 3331 is selectively located between any two adjacent ones of the first planet carrier protrusion segments 3232 to abut and fix the first planet carrier 323 in the corresponding gear. The first ring gear body segment 3241 engages with the first planet gears 322. The first ring gear protrusion segments 3242 are formed on an outer ring surface of the first ring gear body segment 3241 and extend radially outward. Each first driving segment 3321 is selectively located between any two adjacent ones of the first ring gear protrusion segment 3242 to abut and drive the first ring gear 324 in the corresponding gear. Each first fixing segment 3331 is selectively located between any two adjacent ones of the first ring gear protrusion segment 3242 to abut and fix the first ring gear 324 in the corresponding gear. Additionally, in this embodiment, a structural connection between the second switching assembly 43 and the second planetary gear set 42 is completely the same as that between the first switching assembly 33 and the first planetary gear set 32 disclosed above, but in another embodiment, the configuration of the first switching assembly 33 and the configuration of the second switching assembly 43 are not limited thereto.

Figure 4:
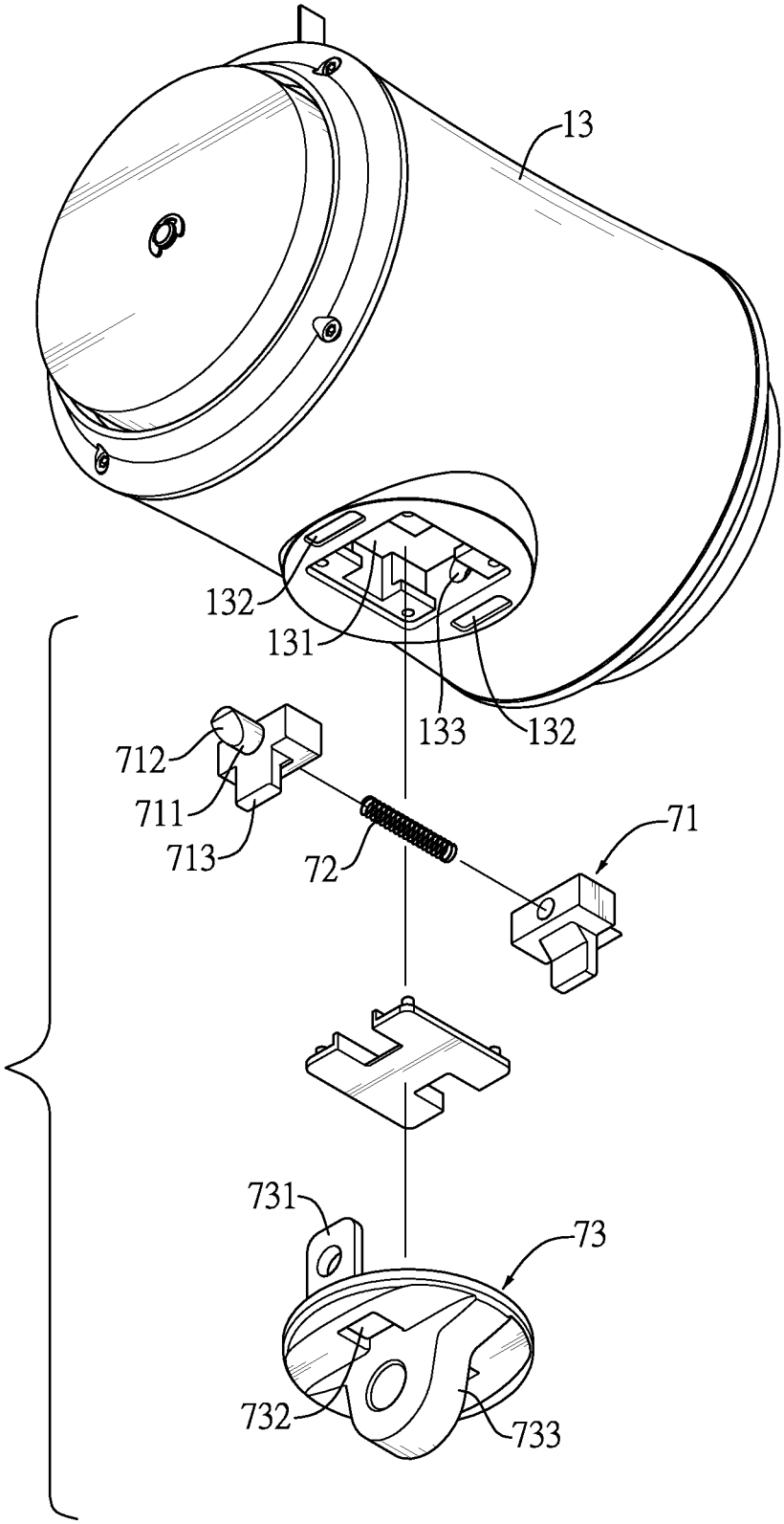
FIG. 4 is another exploded view of the resistance supplier for weight training in FIG. 1, showing the case and the fixing assembly.

In addition, with further reference to FIGS. 2 and 4, in this embodiment, the resistance supplier for weight training further has a case 13 and a fixing assembly 70 configured to connect and fix on other objects.

The spindle 11, the input assembly 20, the first transmission unit 31, the first planetary gear set 32, the first switching assembly 33, the second transmission unit 41, the second planetary gear set 42, the second switching assembly 43, and the output assembly 50 are located in the case 13. Two ends of the spindle 11 are mounted through the case 13 and are respectively connected to the two weights 12 outside the case 13. The pulling rope 22 of the input assembly 20 is mounted through the case 13 via a hole formed on the case 13. The case 13 has a connecting groove 131, two slots 132, and two bolt holes 133. The connecting groove 131 is formed on an outer surface of the case 13. The two slots are formed on the outer surface of the case 13 and are located respectively in two sides of the connecting groove 131. The two bolt holes 133 are respectively formed on two opposite side walls in the connecting groove 131 and respectively communicate with the two slots 132.

Figure 3:
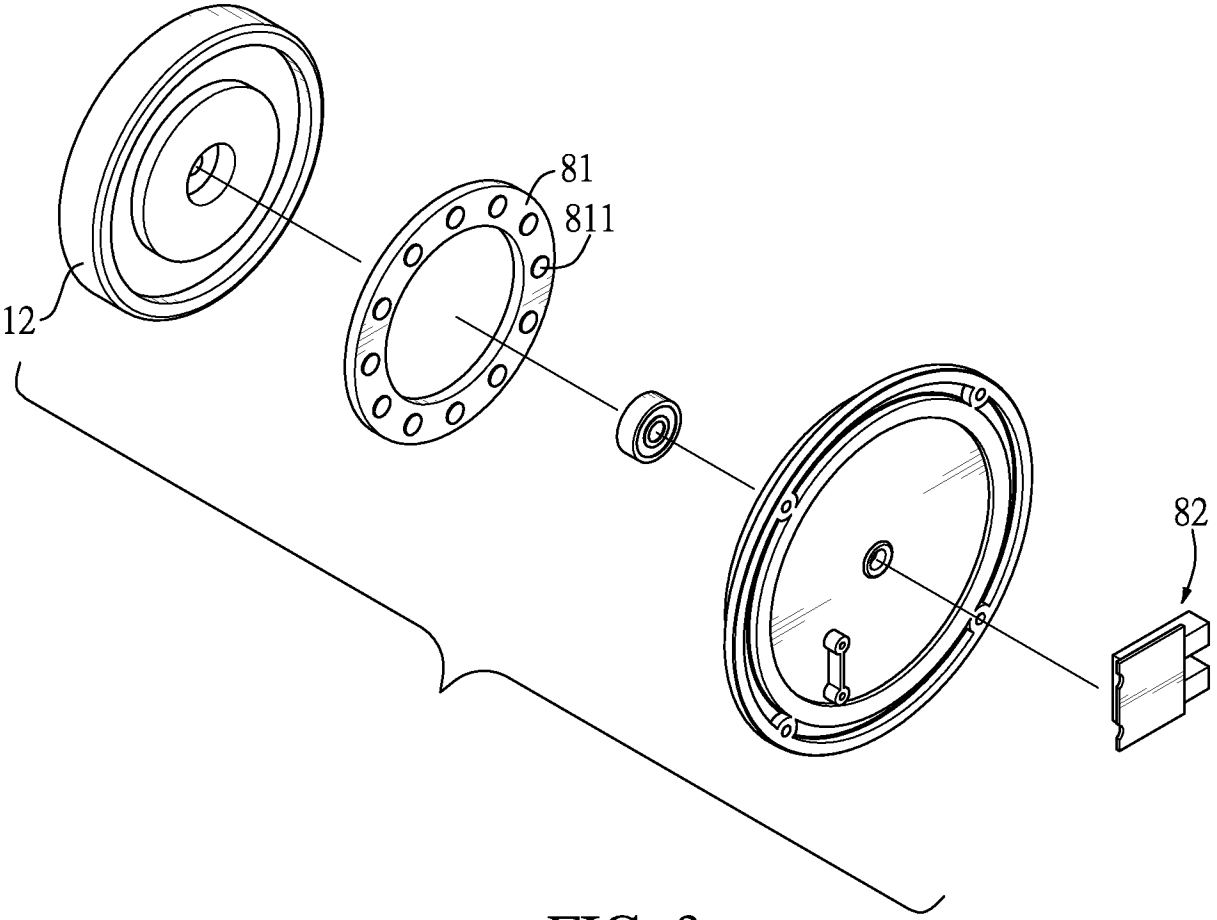
FIG. 3 is an exploded view of the resistance supplier for weight training in FIG. 1, showing the weight, the sensed unit, and the sensor.

The fixing assembly 70 has two latches 71, a spring 72, and a connecting unit 73. The two latches 71 are moveably mounted in the connecting groove 131, and each of the two latches 71 has a bolt segment 711, an inclined surface 712, and a toggling segment 713. The two bolt segments 711 of the two latches 71 are respectively mounted in the two bolt holes 133. The inclined surface 712 is formed on the bolt segment 711. The spring 72 is mounted between the two latches 71, abuts the two latches 71, and is configured to push the two latches 71 away from each other. The connecting unit 73 has two inserting sheet segments 731, two hole segments 732, and a connecting segment 733. The two inserting sheet segments 731 are respectively detachably mounted in the two slots 132. When inserting the two inserting sheet segments 731 in the two slots 132, the two inserting sheet segments 731 respectively abut the inclined surfaces 712 of the two latches 71 and move the two latches 71 toward each other by pushing and sliding relative to the inclined surfaces 712. Each of the two inserting sheet segments 731 forms a buckling hole. The bolt segments 711 of the two latches 71 are adapted to be respectively mounted in the two buckling holes of the two inserting sheet segments 731 to lock the connecting unit 73. The toggling segments 713 of the two latches 71 are respectively mounted in the two hole segments 732 and are capable of moving toward each other in the two hole segments 732. When the toggling segments 713 of the two latches 71 are moved toward each other by the user, the two bolt segments 711 of the two latches 71 are respectively detached from the buckling holes of the two inserting sheet segments 731, thereby unlocking the connecting unit 73. The connecting segment 733 is formed on a side surface, which faces away from the two inserting sheet segments 731, of the connecting unit 73. The connecting segment 733 forms a connecting hole configured to connect and fix on a frame or any other bases. Further, with further reference to FIGS. 2 and 3, in this embodiment, the resistance supplier for weight training further has a sensed unit 81 and a sensor 82 configured to measure rotation speed. The sensed unit 81 is mounted on one of the weights 12 and is capable of rotating along with said weight 12. Specifically, in this embodiment, the sensed unit 81 is in a ring shape and has multiple magnetic poles 811 arranged in a circle (preferably twelve magnetic poles 811). In other words, the sensed unit 81 is a multi-pole magnet ring. The sensor 82 is capable of sensing a rotation speed of the sensed unit 81. Specifically, the sensor 82 is preferably a silicon steel reed sensor, and has a calculation chip and a Bluetooth transmission module. By this, the sensor 82 can sense the movement of the sensed unit 81 through the movement of the twelve magnetic poles 811 and changes of magnetic force, and convert it to a rotation speed by the calculation chip, and then use the Bluetooth transmission module to transmit the measured rotation speed to a portable electronic device (such as a mobile phone or tablet). In this way, the present invention can calculate and provide sports assistance data (such as the calories consumed by the user after exercise) through an App.

By using reduction ratio and enlargement effect of the planetary gear sets to increase the output requirement of the user, the present invention is capable of providing sufficient training resistance through one single small, light weight 12 without the need of multiple weights such as in the conventional weight training equipment. Besides, by switching the input gear, output gear, and release gear of the two planetary gear sets to create different reduction ratios, the present invention can provide a variety of training resistances with one single weight 12. Therefore, the volume, the weight, and the amount of the weights 12 in the present invention can be much less than those of the weights in the conventional weight training equipment. Further, the present invention provides training resistance by rotating the weight 12 instead of lifting up the weight 12, so a tall frame is no longer necessary in the present invention, thereby significantly reducing the volume, and thus the present invention is suitable for ordinary users in the house environment.

In addition, since the present invention provides the training resistance by rotating the weight 12 instead of lifting up the weight 12, and since the training resistance in the present invention can be adjusted by switching the reduction ratio instead of fixing different amounts of weights with a bolt, the risk of being crushed by weights when in use can be completely avoided.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A resistance supplier for weight training comprising:

a spindle having an axial direction;

a first rotating direction; and a second rotating direction being reverse to the first rotating direction;

a first transmission unit rotatably mounted around the spindle;

an input assembly having a one-way input bearing being capable of driving the first transmission unit to rotate along the first rotating direction; and a pulling rope connected to the one-way input bearing; the pulling rope being capable of driving the first transmission unit to rotate along the first rotating direction via the one-way input bearing;

a first planetary gear set having a first sun gear rotatably mounted around the spindle;

multiple first planet gears engaging with the first sun gear;

two first planet carriers; each of the first planet carriers connected to axles of the first planet gears; in the axial direction, the two first planet carriers respectively located in two sides of the first planet gears; and a first ring gear engaging with the first planet gears;

a first switching assembly having a first switching unit being capable of moving along the axial direction relative to the first transmission unit and the first planetary gear set;

a first rotating unit mounted around the first transmission unit; the first transmission unit being capable of driving the first rotating unit to rotate; in the axial direction, the first switching unit abutting two sides of the first rotating unit and being capable of driving the first rotating unit to move along the axial direction relative to the first transmission unit and the first planetary gear set; the first rotating unit having at least one first driving segment being capable of moving along with the first rotating unit relative to the first planetary gear set to connect to one of the two first planet carriers, or to connect to the first ring gear; and a first fixing unit securely mounted on the first switching unit and being capable of moving along with the first switching unit relative to the first planetary gear set; the first fixing unit having at least one first fixing segment being capable of moving along with the first fixing unit relative to the first planetary gear set to connect to and fix one of the two first planet carriers, or to connect to and fix the first ring gear;

wherein when the at least one first driving segment abuts one of the two first planet carriers, the at least one first fixing segment abuts and fixes the first ring gear, and the first rotating unit is capable of driving said one of the two first planet carriers to rotate via the at least one first driving segment, and then said one of the two first planet carriers drives the first sun gear to rotate; and wherein when the at least one first driving segment abuts the first ring gear, the at least one first fixing segment abuts and fixes one of the two first planet carriers, and the first rotating unit is capable of driving the first ring gear to rotate via the at least one first driving segment, and then the first ring gear drives the first sun gear to rotate;

a second transmission unit rotatably mounted around the spindle and securely mounted on the first sun gear;

a second planetary gear set having a second sun gear; the second transmission unit rotatably mounted through the second sun gear;

multiple second planet gears engaging with the second sun gear;

two second planet carriers; each of the two second planet carriers connected to axles of the second planet gears; in the axial direction, the two second planet carriers respectively located in two sides of the second planet gears; and a second ring gear engaging with the second planet gears;

a second switching assembly having a second switching unit being capable of moving along the axial direction relative to the second transmission unit and the second planetary gear set;

a second rotating unit mounted around the second transmission unit; the second transmission unit being capable of driving the second rotating unit to rotate; in the axial direction, the second switching unit abutting two sides of the second rotating unit and being capable of driving the second rotating unit to move along the axial direction relative to the second transmission unit and the second planetary gear set; the second rotating unit having at least one second driving segment being capable of moving along with the second rotating unit relative to the second planetary gear set to connect to one of the two second planet carriers, or to connect to the second ring gear, or not to connect to any one of the two second planet carriers and the second ring gear; and a second fixing unit securely mounted on the second switching unit and being capable of moving along with the second switching unit relative to the second planetary gear set; the second fixing unit having at least one second fixing segment being capable of moving along with the second fixing unit relative to the second planetary gear set to connect to and fix one of the two second planet carriers, or to connect to and fix the second ring gear, or not to connect to any one of the two second planet carriers and the second ring gear;

wherein when the at least one second driving segment abuts one of the two second planet carriers, the at least one second fixing segment abuts and fixes the second ring gear, and the second rotating unit is capable of driving said one of the two second planet carriers to rotate via the at least one second driving segment, and then said one of the two second planet carriers drives the second sun gear to rotate, and the at least one first driving segment abuts one of the two first planet carriers;

wherein when the at least one second driving segment abuts the second ring gear, the at least one second fixing segment abuts and fixes one of the two second planet carriers, and the second rotating unit is capable of driving the second ring gear to rotate via the at least one second driving segment, and then the second ring gear drives the second sun gear to rotate, and the at least one first driving segment abuts the first ring gear; and wherein when the at least one second driving segment does not abut any one of the two second planet carriers and the second ring gear, the at least one second fixing segment does not abut any one of the two second planet carriers and the second ring gear, and the second rotating unit does not drive any one of the two second planet carriers and the second ring gear to rotate via the at least one second driving segment, and the at least one first driving segment abuts the first ring gear;

an output assembly having a driven unit rotatably mounted on the second transmission unit and securely mounted on the second sun gear;

an output unit securely mounted on the driven unit and securely mounted on the spindle; and a one-way output bearing having an output bearing outer ring securely mounted on the driven unit; and an output bearing inner ring securely mounted around the second transmission unit; the output bearing inner ring being capable of driving the output bearing outer ring and the driven unit to rotate along the first rotating direction; the output bearing inner ring being capable of rotating along the second rotating direction relative to the output bearing outer ring; and at least one weight securely mounted on the spindle and being capable of rotating along with the spindle.

2. The resistance supplier for weight training as claimed in claim 1, wherein the first switching unit of the first switching assembly has a first protrusion;

the second switching unit of the second switching assembly has a second protrusion; and the resistance supplier for weight training further has a switch dial having a switch groove; the switch groove being a non-circular ring; the first protrusion and the second protrusion moveably mounted in the switch groove; wherein when the switch dial is turned, the switch dial is capable of respectively moving the first switching unit and the second switching unit along the axial direction via the switch groove, the first protrusion, and the second protrusion.

3. The resistance supplier for weight training as claimed in claim 2, wherein the first rotating unit of the first switching assembly further has a first ring groove formed on an outer ring surface of the first rotating unit; and the first switching unit of the first switching assembly further has a first rib moveably mounted in the first ring groove such that the first rotating unit is capable of rotating along the first rotating direction or the second rotating direction relative to the first switching unit; in the axial direction, the first rib abutting the first ring groove such that the first switching unit is capable of driving the first rotating unit to move along the axial direction via the first rib and the first ring groove.

4. The resistance supplier for weight training as claimed in claim 3, wherein the first switching unit of the first switching assembly further has a first position limiting groove; the first fixing unit mounted in the first position limiting groove and the first position limiting groove abutting two sides of the first fixing unit in the axial direction such that the first fixing unit is fixed relative to the first switching unit in the axial direction; and the first fixing unit of the first switching assembly further has two first position limiting segments protruding from a periphery of the first fixing unit; the two first position limiting segments respectively abutting two ends of the first switching unit such that the first fixing unit is fixed relative to the first switching unit in both the first rotating direction and the second rotating direction.

5. The resistance supplier for weight training as claimed in claim 4, wherein the first rotating unit of the first switching assembly further has a first rotating ring segment; the at least one first driving segment formed on the first rotating ring segment and extending radially inward;

the first fixing unit of the first switching assembly further has a first fixing ring segment; the at least one first fixing segment formed on the first fixing ring segment and extending radially inward;

each of the two first planet carriers of the first planetary gear set has a first planet carrier body segment connected to the axles of the first planet gears; and multiple first planet carrier protrusion segments formed on an outer ring surface of the first planet carrier body segment and extending radially outward; each of the at least one first driving segment selectively located between any two adjacent ones of the first planet carrier protrusion segments; each of the at least one first fixing segment selectively located between any two adjacent ones of the first planet carrier protrusion segments; and the first ring gear of the first planetary gear set has a first ring gear body segment engaging with the first planet gears; and multiple first ring gear protrusion segments formed on an outer ring surface of the first ring gear body segment and extending radially outward;

each of the at least one first driving segment selectively located between any two adjacent ones of the first ring gear protrusion segments; each of the at least one first fixing segment selectively located between any two adjacent ones of the first ring gear protrusion segments.

6. The resistance supplier for weight training as claimed in claim 5, wherein the resistance supplier for weight training further has a case; the spindle, the first transmission unit, the input assembly, the first planetary gear set, the first switching assembly, the second transmission unit, the second planetary gear set, the second switching assembly, and the output assembly located in the case; the case having a connecting groove formed on an outer surface of the case;

two slots formed on the outer surface of the case and located respectively in two sides of the connecting groove; and two bolt holes respectively formed on two opposite side walls in the connecting groove and respectively communicating with the two slots; and a fixing assembly having two latches moveably mounted in the connecting groove; each of the two latches having a bolt segment; the two bolt segments of the two latches respectively mounted in the two bolt holes;

an inclined surface formed on the bolt segment; and a toggling segment;

a spring mounted between the two latches, abutting the two latches, and configured to push the two latches away from each other; and a connecting unit having two inserting sheet segments respectively detachably mounted in the two slots; wherein when inserting the two inserting sheet segments respectively in the two slots, the two inserting sheet segments respectively abut the inclined surfaces of the two latches and move the two latches toward each other by pushing and sliding relative to the inclined surfaces; each of the two inserting sheet segments forms a buckling hole; the two bolt segments of the two latches are adapted to be respectively mounted in the two buckling holes of the two inserting sheet segments to lock the connecting unit;

two hole segments; the two toggling segments of the two latches respectively mounted in the two hole segments and being capable of moving toward each other in the two hole segments; wherein when the two toggling segments of the two latches are moved toward each other, the two bolt segments of the two latches are respectively detached from the buckling holes of the two inserting sheet segments; and a connecting segment formed on a side surface, which faces away from the two inserting sheet segments, of the connecting unit; the connecting segment forming a connecting hole.

7. The resistance supplier for weight training as claimed in claim 6, wherein the resistance supplier for weight training further has a sensed unit mounted on one of the at least one weight and being capable of rotating along with said one of the at least one weight; and a sensor being capable of sensing a rotation speed of the sensed unit.

8. The resistance supplier for weight training as claimed in claim 7, wherein the sensed unit is in a ring shape and has multiple magnetic poles arranged in a circle; and the sensor is capable of sensing movement of the magnetic poles.

9. The resistance supplier for weight training as claimed in claim 1, wherein the first rotating unit of the first switching assembly further has a first ring groove formed on an outer ring surface of the first rotating unit; and the first switching unit of the first switching assembly further has a first rib moveably mounted in the first ring groove such that the first rotating unit is capable of rotating along the first rotating direction or the second rotating direction relative to the first switching unit; in the axial direction, the first rib abutting the first ring groove such that the first switching unit is capable of driving the first rotating unit to move along the axial direction via the first rib and the first ring groove.

10. The resistance supplier for weight training as claimed in claim 1, wherein the first switching unit of the first switching assembly further has a first position limiting groove; the first fixing unit mounted in the first position limiting groove and the first position limiting groove abutting two sides of the first fixing unit in the axial direction such that the first fixing unit is fixed relative to the first switching unit in the axial direction; and the first fixing unit of the first switching assembly further has two first position limiting segments protruding from a periphery of the first fixing unit; the two first position limiting segments respectively abutting two ends of the first switching unit such that the first fixing unit is fixed relative to the first switching unit in both the first rotating direction and the second rotating direction.

11. The resistance supplier for weight training as claimed in claim 1, wherein the first rotating unit of the first switching assembly further has a first rotating ring segment; the at least one first driving segment formed on the first rotating ring segment and extending radially inward;

the first fixing unit of the first switching assembly further has a first fixing ring segment; the at least one first fixing segment formed on the first fixing ring segment and extending radially inward;

each of the two first planet carriers of the first planetary gear set has a first planet carrier body segment connected to the axles of the first planet gears; and multiple first planet carrier protrusion segments formed on an outer ring surface of the first planet carrier body segment and extending radially outward; each of the at least one first driving segment selectively located between any two adjacent ones of the first planet carrier protrusion segments; each of the at least one first fixing segment selectively located between any two adjacent ones of the first planet carrier protrusion segments; and the first ring gear of the first planetary gear set has a first ring gear body segment engaging with the first planet gears; and multiple first ring gear protrusion segments formed on an outer ring surface of the first ring gear body segment and extending radially outward;

each of the at least one first driving segment selectively located between any two adjacent ones of the first ring gear protrusion segments; each of the at least one first fixing segment selectively located between any two adjacent ones of the first ring gear protrusion segments.

12. The resistance supplier for weight training as claimed in claim 1, wherein the resistance supplier for weight training further has a case; the spindle, the first transmission unit, the input assembly, the first planetary gear set, the first switching assembly, the second transmission unit, the second planetary gear set, the second switching assembly, and the output assembly located in the case; the case having a connecting groove formed on an outer surface of the case;

two slots formed on the outer surface of the case and located respectively in two sides of the connecting groove; and two bolt holes respectively formed on two opposite side walls in the connecting groove and respectively communicating with the two slots; and a fixing assembly having two latches moveably mounted in the connecting groove; each of the two latches having a bolt segment; the two bolt segments of the two latches respectively mounted in the two bolt holes;

an inclined surface formed on the bolt segment; and a toggling segment;

a spring mounted between the two latches, abutting the two latches, and configured to push the two latches away from each other; and a connecting unit having two inserting sheet segments detachably mounted in the two slots respectively; wherein when inserting the two inserting sheet segments respectively in the two slots, the two inserting sheet segments respectively abut the inclined surfaces of the two latches and move the two latches toward each other by pushing and sliding relative to the inclined surfaces; each of the two inserting sheet segments forms a buckling hole; the two bolt segments of the two latches are adapted to be respectively mounted in the two buckling holes of the two inserting sheet segments to lock the connecting unit;

two hole segments; the two toggling segments of the two latches respectively mounted in the two hole segments and being capable of moving toward each other in the two hole segments; wherein when the two toggling segments of the two latches are moved toward each other, the two bolt segments of the two latches are respectively detached from the buckling holes of the two inserting sheet segments; and a connecting segment formed on a side surface, which faces away from the two inserting sheet segments, of the connecting unit; the connecting segment forming a connecting hole.

13. The resistance supplier for weight training as claimed in claim 1, wherein the resistance supplier for weight training further has a sensed unit mounted on one of the at least one weight and being capable of rotating along with said one of the at least one weight; and a sensor being capable of sensing a rotation speed of the sensed unit.

14. The resistance supplier for weight training as claimed in claim 13, wherein the sensed unit is in a ring shape and has multiple magnetic poles arranged in a circle; and the sensor is capable of sensing movement of the magnetic poles.

* * * * *